US009387717B2

(12) United States Patent
Iwata et al.

(10) Patent No.: US 9,387,717 B2
(45) Date of Patent: Jul. 12, 2016

(54) SHEET PROCESSING APPARATUS AND IMAGE FORMING APPARATUS WITH ROTARY MEMBER TO CONVEY SHEETS

(71) Applicant: CANON KABUSHIKI KAISHA, Tokyo (JP)

(72) Inventors: Toshiyuki Iwata, Abiko (JP); Naoto Tokuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 14/465,948

(22) Filed: Aug. 22, 2014

(65) Prior Publication Data

US 2015/0123338 A1 May 7, 2015

(30) Foreign Application Priority Data

Aug. 30, 2013 (JP) ..... 2013-178991

(51) Int. Cl.
*B65H 37/04* (2006.01)
*B42C 1/12* (2006.01)
(Continued)

(52) U.S. Cl.
CPC *B42C 1/12* (2013.01); *B65H 29/12* (2013.01); *B65H 29/70* (2013.01); *B65H 31/3027* (2013.01); *B65H 31/3081* (2013.01); *B65H 31/34* (2013.01); *B65H 37/04* (2013.01); *B65H 2301/4212* (2013.01); *B65H 2301/4213* (2013.01); *B65H 2301/5122* (2013.01);
(Continued)

(58) Field of Classification Search
CPC ..... B65H 37/04
USPC ..... 270/58.11
See application file for complete search history.

(56) References Cited

U.S. PATENT DOCUMENTS 6,517,065 B2 * 2/2003 Miyake ..... B65H 29/51 270/58.09
6,666,444 B1 * 12/2003 Paoli ..... B65H 29/22 270/58.08

(Continued)

FOREIGN PATENT DOCUMENTS

| | | | |
|---|---|---|---|
| JP | 2000-063006 A | | 2/2000 |
| JP | 2001-335224 A | | 12/2001 |
| JP | 2001335224 A | * | 12/2001 |
| JP | 2005-262682 A | | 9/2005 |
| JP | 2012-096869 A | | 5/2012 |

OTHER PUBLICATIONS

Office Action dated Dec. 8, 2015, in Japanese Patent Application No. 2014-174822.

*Primary Examiner* — Patrick Mackey
(74) *Attorney, Agent, or Firm* — Fitzpatrick, Cella, Harper & Scinto

(57) ABSTRACT

A sheet processing apparatus includes a sheet conveying portion conveying a sheet to a sheet stacking portion; a regulating portion regulating a position of the sheet on the stacking portion; a rotary member pair having first and second rotary members and conveying the sheet toward the regulating portion through rotation in a first direction, and conveying a bound sheet bundle through rotation in a second direction opposite to the first direction; a moving portion moving the second rotary member to a separation position after the rotary member pair conveys the sheet, and moving the second rotary member to a nipping position before the rotary member pair conveys the sheet bundle; and a control portion controlling to rotate the rotary member pair in the second direction after the second rotary member is moved to the separation position and before the second rotary member is moved to the nipping position.

10 Claims, 16 Drawing Sheets

(51) Int. Cl.

| | |
|---|---|
| ***B65H 29/12*** | (2006.01) |
| ***B65H 29/70*** | (2006.01) |
| ***B65H 31/30*** | (2006.01) |
| ***B65H 31/34*** | (2006.01) |

(52) U.S. Cl.
CPC ..... *B65H2404/144* (2013.01); *B65H 2404/166* (2013.01); *B65H 2701/18292* (2013.01); *B65H 2801/27* (2013.01)

(56) References Cited

U.S. PATENT DOCUMENTS

| | | | | |
|---|---|---|---|---|
| 7,165,764 | B2 * | 1/2007 | Nakamura | B42C 1/12 270/58.08 |
| 7,780,159 | B2 * | 8/2010 | Nishimura | B65H 5/34 270/58.01 |
| 2014/0015188 | A1 | 1/2014 | Tokuma et al. | |

* cited by examiner

SHEET PROCESSING APPARATUS AND IMAGE FORMING APPARATUS WITH ROTARY MEMBER TO CONVEY SHEETS

BACKGROUND OF THE INVENTION

1. Field of the Invention

The present invention relates to a sheet processing apparatus and an image forming apparatus.

2. Description of the Related Art

Hitherto, as an image forming apparatus such as a copying machine, a laser beam printer, a facsimile machine, and a multifunction peripheral having functions of those apparatus, there is an image forming apparatus including a sheet processing apparatus configured to perform processes such as a binding process and a sorting process on sheets having images formed thereon. Further, there is widely known an image forming apparatus (image forming system) including the sheet processing apparatus connected to a discharge port formed in a main body of the image forming apparatus so as to automatically perform the above-mentioned processes on the sheets on-line.

As the sheet processing apparatus, there is widely used a sheet processing apparatus configured to perform the processes such as a binding process on a sheet bundle, which is formed by stacking a plurality of sheets onto an intermediate processing tray provided inside the sheet processing apparatus. For example, there is an apparatus configured to bind the sheet bundle by a binding unit at the time of the binding process, discharge the bound sheet bundle from the intermediate processing tray by a bundle discharge roller pair serving as a rotary member pair, and stack the discharged sheet bundle onto a stacking tray (see Japanese Patent Application Laid-Open No. 2012-96869).

When a first sheet is to be stacked onto the intermediate processing tray, an upper bundle discharge roller of the bundle discharge roller pair is lowered so as to nip the sheet between the upper bundle discharge roller and a lower bundle discharge roller. Then, the upper bundle discharge roller is rotated in a reverse direction so as to convey the sheet toward a trailing edge stopper provided on the intermediate processing tray. When a second or subsequent sheet is to be stacked, the upper bundle discharge roller is moved upwardly so as not to interfere with the succeeding sheet sliding toward the trailing edge stopper along an upper surface of the sheet, which is already stacked on the intermediate processing tray. When the sheet bundle is bound and the bound sheet bundle is to be discharged, the upper bundle discharge roller is lowered so as to nip the sheet bundle between the upper bundle discharge roller and the lower bundle discharge roller, to thereby discharge the sheet bundle.

When the first sheet is to be stacked onto the intermediate processing tray in the related-art sheet processing apparatus, the bundle discharge roller pair is rotated in the direction opposite to the rotational direction at the time of discharging the sheet onto the stacking tray. In this case, the drive configuration of the bundle discharge roller pair is set so that the drive is first transmitted to the lower bundle discharge roller and then transmitted to the upper bundle discharge roller via a drive transmission unit including a plurality of gears. That is, when the sheet bundle is to be discharged onto the stacking tray in the related-art sheet processing apparatus, the lower bundle discharge roller is first rotated, and the rotation of the lower bundle discharge roller is then transmitted via the drive transmission unit so that the upper bundle discharge roller is rotated.

In the case of this drive configuration, when the bound sheet bundle is to be discharged onto the stacking tray, during the rotation of the lower bundle discharge roller in the sheet discharge direction, backlashes of the drive transmission unit may cause a delay in the drive transmission to the upper bundle discharge roller. As a result, the start of rotation of the upper bundle discharge roller is delayed as compared to the lower bundle discharge roller.

Thus, when the sheet bundle is to be discharged, a lower sheet of the sheet bundle, which is held in contact with the lower bundle discharge roller, is conveyed but, due to the delay in the start of rotation of the upper bundle discharge roller, an upper sheet of the sheet bundle, which is held in contact with the upper bundle discharge roller, is not conveyed at this time, with the result that the upper sheet is distorted. When the drive is then transmitted to the upper bundle discharge roller, the sheet bundle is conveyed under a state in which the upper sheet is distorted. When the sheet bundle is conveyed in this state, the binding portion of the sheet bundle passes through the bundle discharge roller pair without a relief region for the distorted portion of the upper sheet. The distorted portion is crushed by the bundle discharge roller pair, with the result that creases may be generated in the binding portion.

To prevent the generation of creases, there is conceived a method of reducing a press-contact force of the bundle discharge roller pair to suppress the distortion of the upper sheet when the bundle discharge roller pair abuts against the sheet bundle and conveys the sheet bundle. When the conveyance force of the bundle discharge roller pair is excessively reduced, however, in a case of a thick sheet bundle, the conveyance force is insufficient, which may cause slippage between the bundle discharge rollers and the sheet bundle during the conveyance of the sheet bundle by the bundle discharge roller pair. When the sheet bundle is slipped, marks of slippage are generated on the surface of the sheet bundle by the bundle discharge roller pair, with the result that the quality of a product may be degraded.

SUMMARY OF THE INVENTION

The present invention has been made in view of the above-mentioned circumstances, and provides a sheet processing apparatus capable of preventing degradation of the quality of a product.

According to one example of the present invention, there is provided a she processing apparatus, including: a sheet conveying portion configured to convey the sheet; a sheet stacking portion on which a sheet conveyed by the sheet conveying portion is stacked; a regulating portion configured to regulate a position of the sheet on the sheet stacking portion; a binding portion configured to bind a plurality of sheets regulated by the regulating portion; a rotary member pair having a first rotary member and a second rotary member, the rotary member pair configured to convey the sheet toward the regulating portion through rotation in a first direction, and configured to convey a sheet bundle, which is bound by the binding portion, through rotation in a second direction opposite to the first direction; a moving portion configured to move the second rotary member to a separation position, at which the second rotary member is separated away from the first rotary member, after the rotary member pair conveys the sheet toward the regulating portion, and configured to move the second rotary member from the separation position to a nipping position, at which the second rotary member and the first rotary member nip the sheet bundle, before the rotary member pair conveys the bound sheet bundle; a drive portion configured to drive the first rotary member and the second rotary member; and a control portion configured to control the drive portion and the moving portion so as to rotate the rotary member pair in the second direction after the second rotary member is moved to the separation position and before the second rotary member is moved to the nipping position.

According to other example of the present invention, there is provided a sheet processing apparatus, including: a sheet stacking portion on which a sheet is stacked; a binding portion configured to bind a plurality of sheets stacked on the sheet stacking portion; a rotary member pair configured to convey a sheet toward the binding portion through rotation in a first direction, and configured to convey a bound sheet bundle, which is bound by the binding portion, through rotation in second direction opposite to the first direction; a changing portion configured to change a state of the rotary member pair into a state in which the rotary member pair does not nip a sheet after the rotary member pair conveys the sheet toward the binding portion, and thereafter to change the state of the rotary member pair into a nipping state in which the rotary member pair nips the bound sheet bundle; a drive portion configured to drive the rotary member pair; and a control portion configured to control the drive portion so as to rotate the rotary member pair in the second direction while the state of the rotary member pair is in the state in which the rotary member pair does not nip a sheet.

According to other example of the present invention, there is provided an image forming apparatus, including: an image forming portion; a sheet stacking portion on which a sheet having an image formed thereon by the image forming portion is stacked; a regulating portion configured to regulate a position of the sheet on the sheet stacking portion; a binding portion configured to bind a plurality of sheets regulated by the regulating portion; a rotary member pair having a first rotary member and a second rotary member, the rotary member pair configured to convey sheet toward the regulating portion through rotation in a first direction, and configured to convey a sheet bundle, which is bound by the binding portion, through rotation in a second direction opposite to the first direction; a moving portion configured to move the second rotary member to a separation position, at which the second rotary member is separated away from the first rotary member, after the rotary member pair conveys the sheet toward the regulating portion, and configured to move the second rotary member from the separation position to a nipping position, at which the second rotary member and the first rotary member nip the sheet bundle, before the rotary member pair conveys the bound sheet bundle; a drive portion configured to drive the first rotary member and the second rotary member; and a control portion configured to control the drive portion and the moving portion so as to rotate the rotary member pair in the second direction after the second rotary member is moved to the separation position and before the second rotary member is moved to the nipping position.

Further features of the present invention will become apparent from the following of exemplary embodiments with reference to the attached drawings.

DESCRIPTION OF THE EMBODIMENTS

Figure 1:
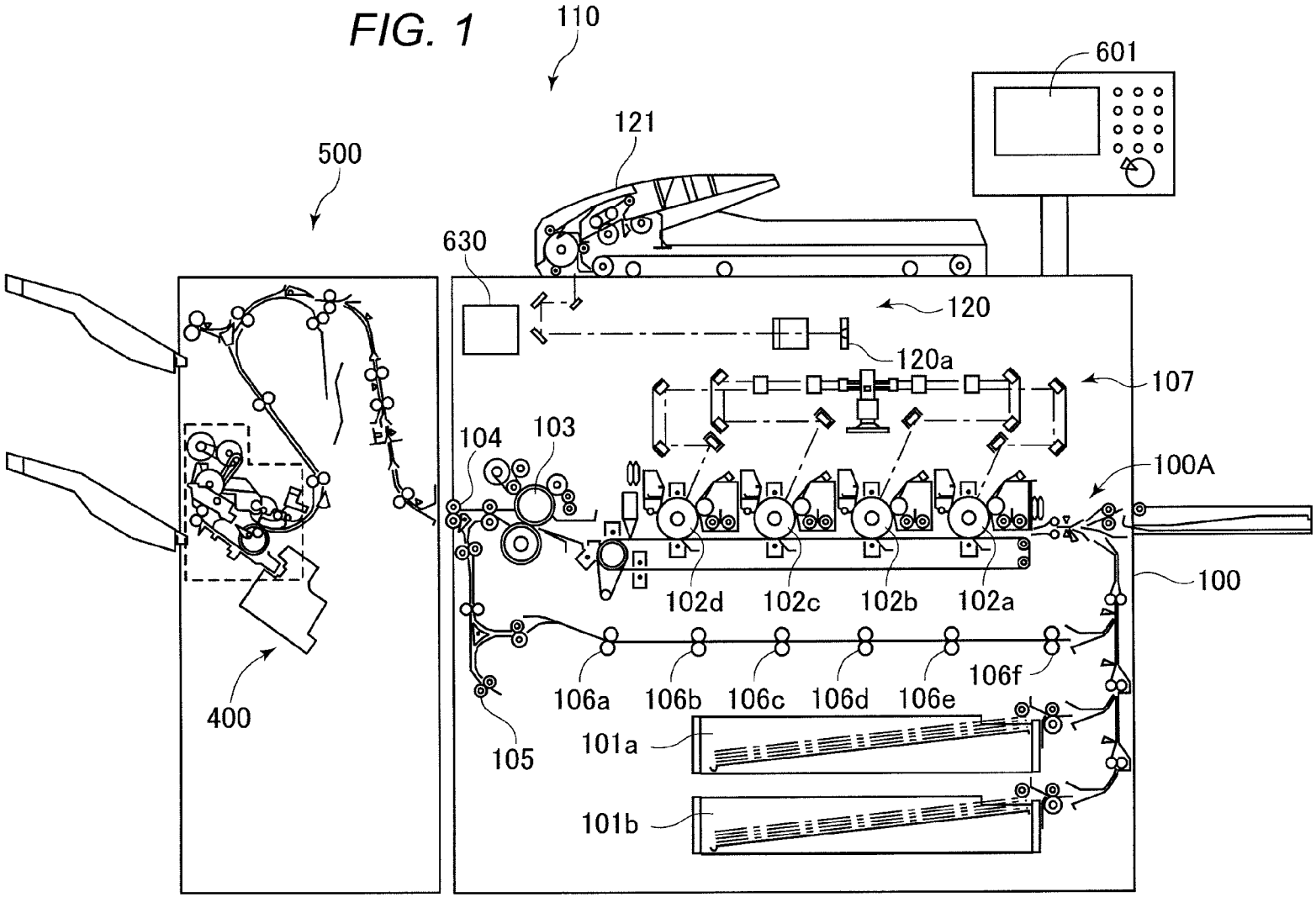
FIG. 1 illustrates a configuration of a monochrome/color copying machine as an example of an image forming apparatus including a sheet processing apparatus according to a first embodiment of the present invention.

Now, exemplary embodiments of the present invention are described in detail with reference to the drawings. FIG. 1 illustrates a configuration of a monochrome/color copying machine as an example of an image forming apparatus including a sheet processing apparatus according to a first embodiment of the present invention. FIG. 1 illustrates a monochrome/color copying machine 110, a main body 100 of the monochrome/color copying machine 110 (hereinafter referred to as "copying machine main body"), an original reading portion (image reader) 120 provided in an upper portion of the copying machine main body 100, and an original conveying device 121 configured to automatically read a plurality of originals.

The copying machine main body 100 includes sheet feeding cassettes 101*a* and 101*b* configured to stack normal sheets to be subjected to image formation, an image forming portion 100A configured to form toner images on the sheets through an electrophotographic printing process, and a fixing portion 103 configured to fix the toner images formed on the sheets. An operation portion 601 configured to allow a user to perform various inputs/settings on the copying machine main body 100 is connected to an upper surface of the copying machine main body 100. A finisher 500 serving as a sheet processing apparatus is connected to a side of the copying machine main body 100. Note that, a CPU circuit portion 630 is a control portion configured to control the copying machine main body 100 and the finisher 500.

The monochrome/color copying machine 110 forms an image of an original (not shown) on the sheets as follows. First, the image of the original conveyed by the original conveying device 121 is read with an image sensor 120*a* provided to the original reading portion 120. Then, digital data of the read image is input to an exposure device 107. The exposure device 107 radiates beams corresponding to the digital data to photosensitive drums 102 (102*a*, 102*b*, 102*c*, and 102*d*) provided in the image forming portion 100A. When the beams are radiated, electrostatic latent images are formed on surfaces of the photosensitive drums. Through development of the electrostatic latent images, yellow, magenta, cyan, and black toner images are formed respectively on the surfaces of the photosensitive drums.

Next, the toner images of those four colors are transferred onto the sheet fed from sheet feeding cassette 101*a* or 101*b*. Then, the toner images transferred onto the sheet are permanently fixed with the fixing portion 103. In a mode of forming an image only on one side of the sheet, after the fixation of the toner images, the sheet is discharged as it is by a discharge roller pair 104 into the finisher 500 connected to the side portion of the copying machine main body 100.

In a mode of forming images on both sides of the sheet, the sheet is delivered from the fixing portion 103 to reverse rollers 105. Then, the reverse rollers 105 are reversed at a predetermined timing so that the sheet is conveyed toward duplex conveying rollers 106 (106*a*, 106*b*, 106*c*, 106*d*, 106*e*, and 106*f*). After that, the sheet is re-conveyed to the image forming portion 100A so that the toner images of the four colors of yellow, magenta, cyan, and black are transferred onto a back surface. After the toner images of the four colors are transferred onto the back surface, the sheet is re-conveyed to the fixing portion 103 so that the toner images are fixed. Then, the sheet is discharged by the discharge roller pair 104 and is conveyed into the finisher 500.

The finisher 500 sequentially introduces the sheets discharged from the copying machine main body 100, and performs a process of aligning and bundling the plurality of introduced sheets into one bundle, and a punching process of punching a hole in the vicinity of a trailing edge of each of the introduced sheets. Further, the finisher 500 performs, for example, a stapling process (binding process) of stapling a trailing edge side of the sheet bundle. The finisher 500 includes a stapling portion 400 serving as a binding portion configured to staple the sheets.

Figure 2:
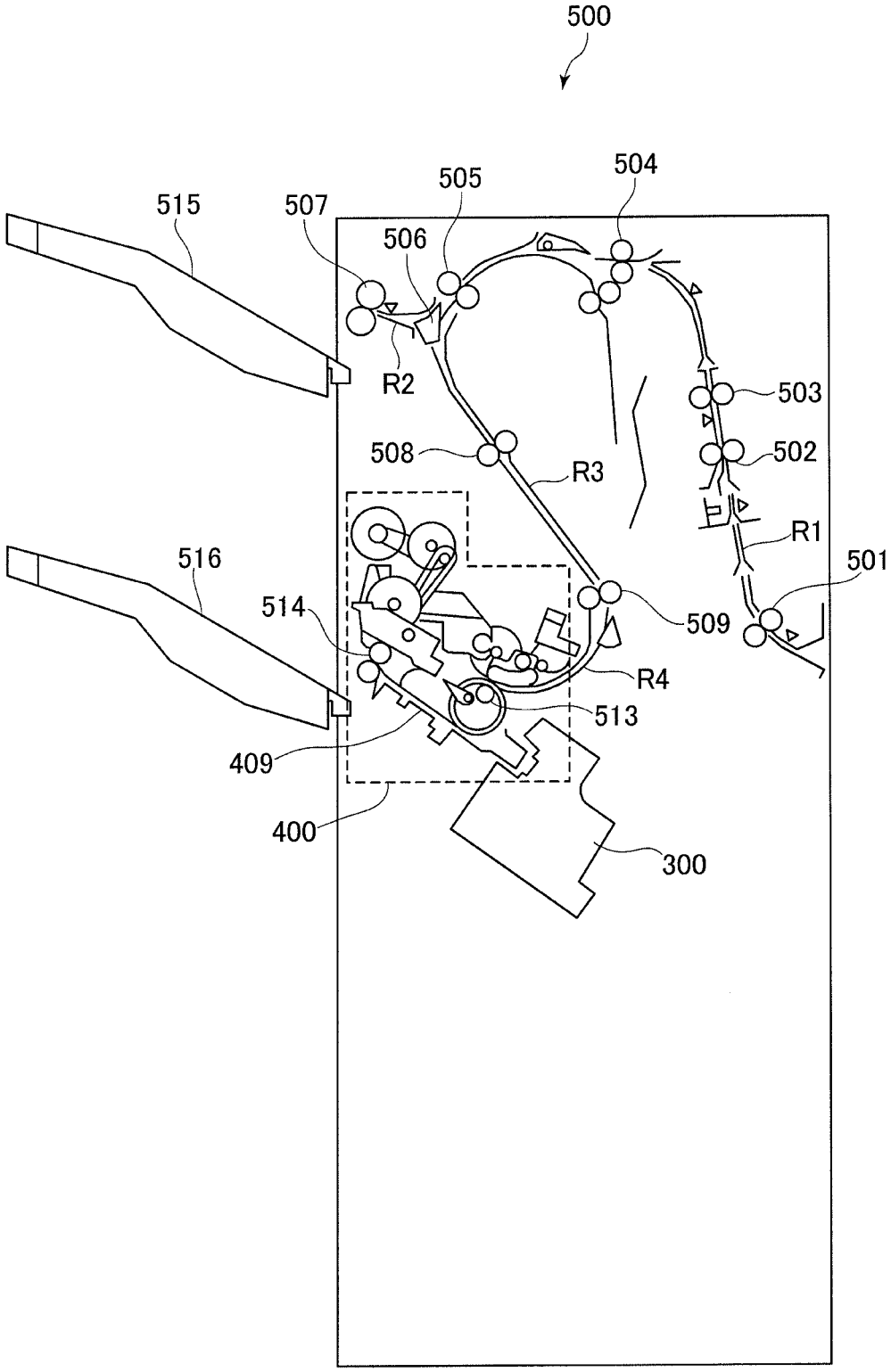
FIG. 2 illustrates a configuration of a finisher serving as the sheet processing apparatus.

As illustrated in FIG. 2, the finisher 500 includes an inlet roller pair 501 configured to introduce the sheets to an inside of the finisher 500. The sheets discharged from the copying machine main body 100 are received by the inlet roller pair 501. After that, the sheet conveyed by the inlet roller pair 501 passes through a conveying path R1. While passing through the conveying path R1, misalignment of the sheet in a width direction orthogonal to a sheet conveying direction is corrected by shift roller pairs 502 and 503.

After the misalignment of the sheet in the width direction is corrected, the sheet is then conveyed by conveying rollers 504, and reaches a buffer roller pair 505. After that, when the sheet is discharged onto an upper tray 515, a drive portion (not shown) such as a solenoid causes an upper path switching member 506 to rotate clockwise. With this, the sheet is guided to an upper conveying path R2, and is discharged by upper discharge rollers 507 onto the upper tray 515. When the sheet conveyed by the buffer roller pair 505 is not discharged onto the upper tray 515, the sheet is guided to a bundle conveying path R3 by the upper path switching member 506 illustrated by a solid line. After that, conveying rollers 508 and a bundle conveying roller pair 509 cause the sheet to sequentially pass through the conveying path, and the sheet is conveyed to a discharge path R4.

The sheet conveyed to the discharge path R4 is then sequentially conveyed by a lower discharge roller pair 513 serving as a sheet conveying portion onto an intermediate processing tray 409 serving as a sheet stacking portion configured to process the sheet bundle formed by stacking the sheets in alignment state. On the intermediate processing tray, a predetermined number of the conveyed sheets are aligned by a returning portion including a draw-in paddle 414 and a belt roller 416 illustrated in FIGS. 5A and 5B.

When a preceding sheet bundle is being aligned or bound on the intermediate processing tray, a predetermined number of first sheets for forming a succeeding sheet bundle are superimposed one on top of the other through forward and reverse rotation of the buffer roller pair 505. After the preceding sheet bundle is discharged, the predetermined number of first sheets are conveyed to the intermediate processing tray 409. The process of superimposing the predetermined number of first sheets for forming the succeeding sheet bundle one on top of the other is a buffering process to be performed for the purpose of securing a processing time of the preceding sheet bundle on the intermediate processing tray. Subsequent sheets for forming the succeeding sheet bundle are sequentially conveyed to the intermediate processing tray 409 one by one.

Next, the sheet, bundle aligned on the intermediate processing tray is bound as appropriate by a stapler 300 serving as a binding portion. After that, the sheet bundle is discharged by a bundle discharge roller pair 514 onto the lower stacking tray 516. The stapler 300 is freely movable in the width direction orthogonal to the sheet conveying direction (hereinafter referred to as "depth direction"). The stapler 300 is capable of binding a plurality of points on the trailing edge portion of the sheet bundle.

Figure 3:
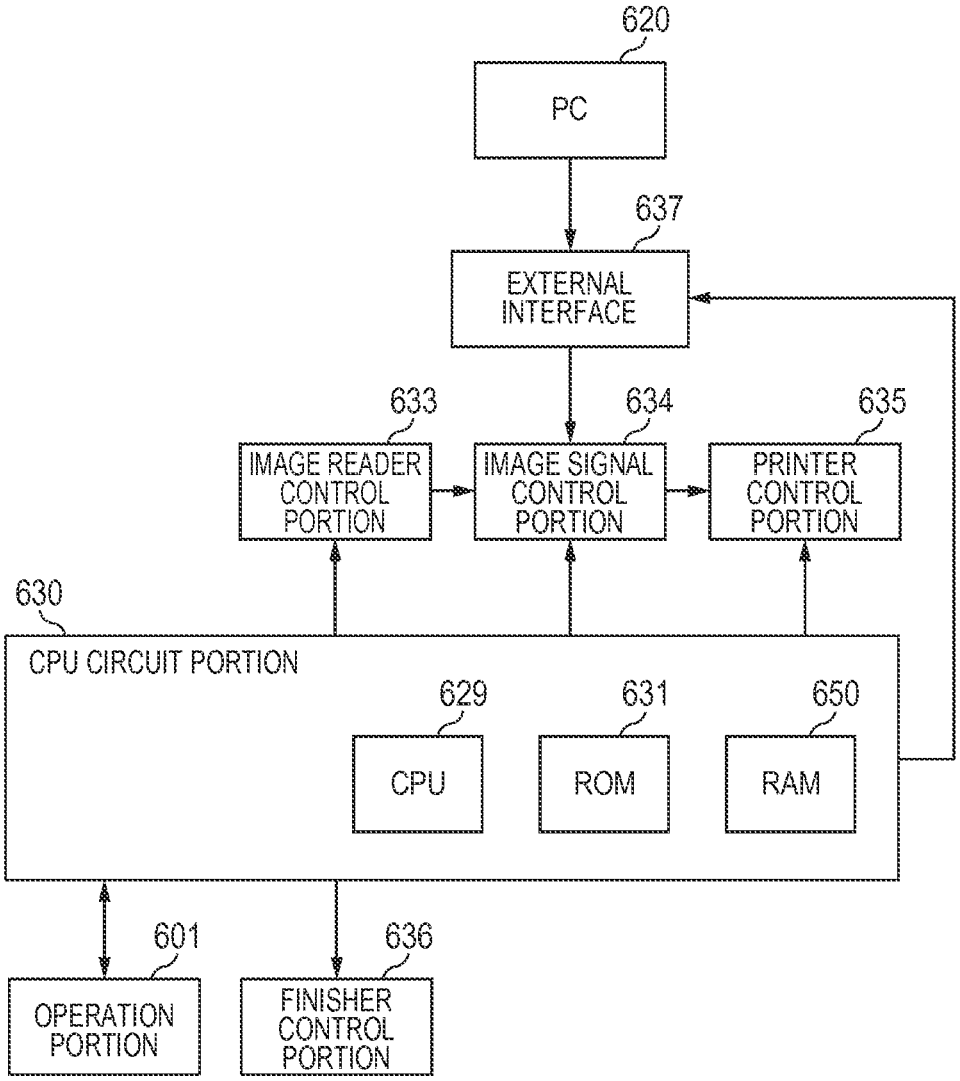
FIG. 3 is a control block diagram of the monochrome/color copying machine.

FIG. 3 is a control block diagram of the monochrome/color copying machine 110. The CPU circuit portion 630 includes a CPU 629, a ROM 631 for storing control programs and the like, and a RPM 650 to be used as an area for temporarily storing control data or as a work area for arithmetic operations for control. Further, FIG. 3 illustrates an external interface 637 for connecting the monochrome/color copying machine 110 and an external PC (computer) 620 to each other. When receiving print data from the external PC 620, the external interface 637 develops the received data into a bit-mapped image, and outputs the bit-mapped image as image data to an image signal control portion 634.

The image signal control portion 634 outputs the data to a printer control portion 635, and the printer control portion 635 outputs data from the image signal control portion 634 to an exposure control portion (not shown). Note that, an image reader control portion 633 outputs an image of an original read by the image sensor 120*a* (see FIG. 1) to the image signal, control portion 634, and the image signal control portion 634 outputs the image to the printer control portion 635.

The operation portion 601 includes a plurality of keys for setting various functions of image formation, a display portion for displaying setting conditions, and the like. The operation portion 601 outputs key signals corresponding to operations of the keys by a user to the CPU circuit portion 630, and in response to signals from the CPU circuit portion 630, displays information pieces corresponding to the signals on the display portion.

Based on the control programs stored in the ROM 631 and the settings from the operation portion 601, the CPU circuit portion 630 controls the image signal control portion 634, and the original conveying device 121 (see FIG. 1). The CPU circuit portion 630 also controls the original reading portion 120 (see FIG. 1) via the image reader control portion 633, the image forming portion 100A (see FIG. 1) via the printer control portion 635, and the finisher 500 via a finisher control portion 636.

In this embodiment, the finisher control portion 636 is mounted to the finisher 500, and drives and controls the finisher 500 through exchange of information with the CPU circuit portion 630. The finisher control portion 636 may be arranged integrally with the CPU circuit portion 630 on the copying machine main body side so that the finisher 500 is directly controlled from the copying machine main body.

Figure 4:
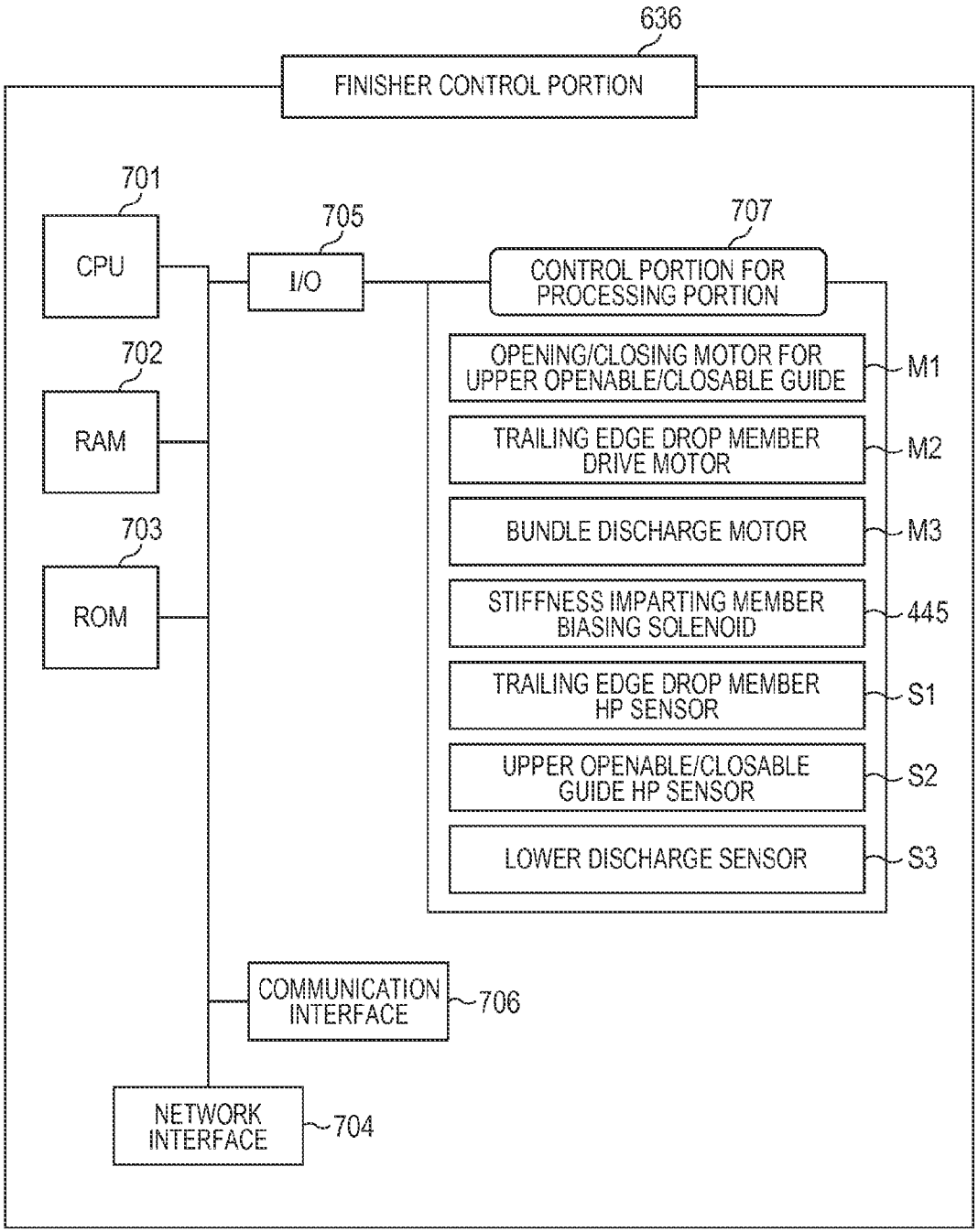
FIG. 4 is a control block diagram of the finisher.

FIG. 4 is a control block diagram of the finisher 500 according to this embodiment. The finisher control portion 636 includes a CPU (microcomputer) 701, a RAM 702, a ROM 703, an input/output portion (I/O) 705, a communication interface 706, and a network interface 704. The input/output portion (I/O) 705 is connected to a control portion 707 for a processing portion, a conveyance control portion (not shown), a binding control portion (not shown), and the like. The control portion 707 for a processing portion is connected to an opening/closing motor M1 for an upper openable/closable guide, a trailing edge drop member drive motor M2, a bundle discharge motor M3, a stiffness imparting member biasing solenoid 445, a trailing edge drop member HP sensor S1, an upper openable/closable guide HP sensor S2, and a lower discharge sensor S3. The control portion 707 for a processing portion is configured to control the opening/closing motor M1 for the upper openable/closable guide, the trailing edge drop member drive motor M2, the bundle discharge motor M3, and the stiffness imparting member biasing solenoid 445 based on detection results from the trailing edge drop member HP sensor S1, the upper openable/closable guide HP sensor S2, and the lower discharge sensor S3.

Figure 5A:
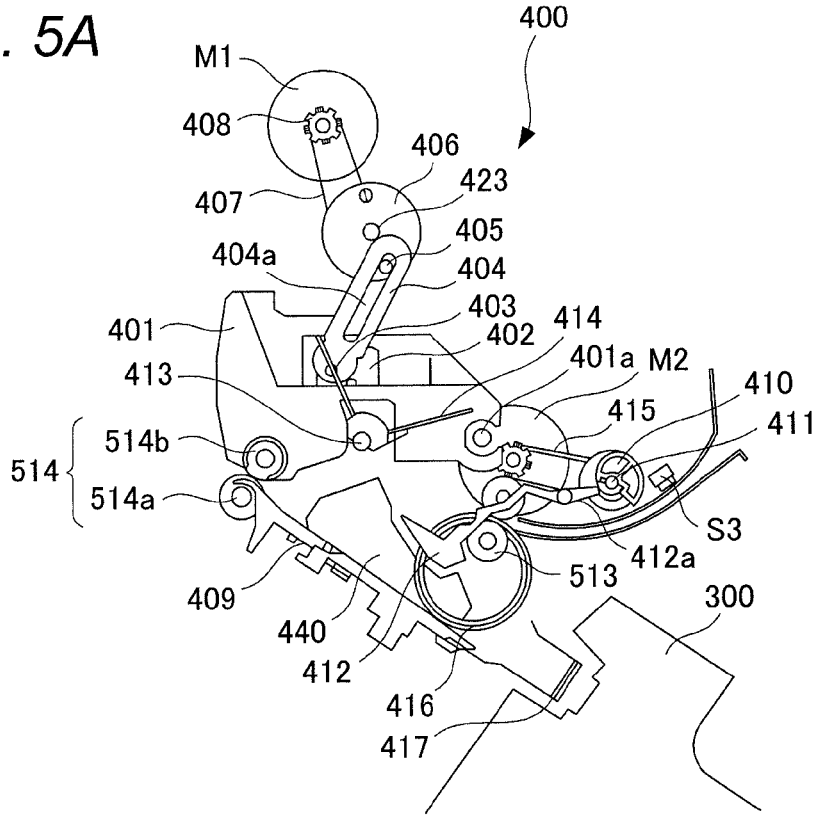
FIGS. 5A and 5B illustrate a configuration of a stapling portion provided to the finisher.
Figure 5B:
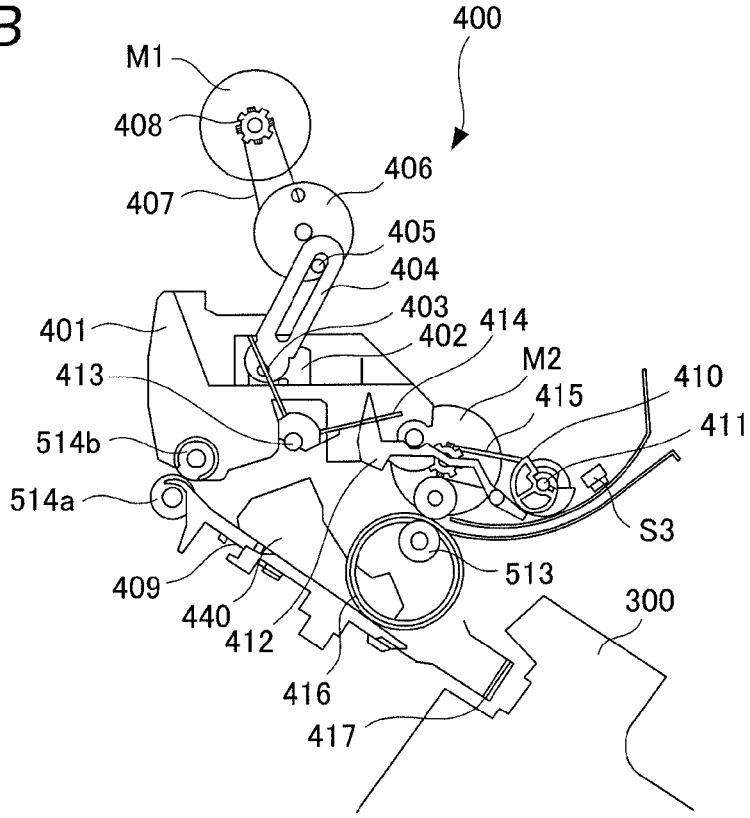

Next, a configuration of the stapling portion 400 including the intermediate processing tray 409 is described. As illustrated in FIGS. 5A and 5B, the intermediate processing tray 409 is arranged so as to be inclined upwardly on a downstream side (left side of FIGS. 5A and 5B) and downwardly on an upstream side (right side of FIGS. 5A and 5B) with respect to a discharge direction of the sheet bundle. The intermediate processing tray 409 includes a trailing edge stopper 417 arranged at its lower edge portion on the upstream side in the discharge direction. The intermediate processing tray 409 may be arranged horizontally.

The intermediate processing tray 409 includes, at its middle portion, a pair of alignment plates 440 configured to move independently of each other along the width direction relative to the intermediate processing tray 409 and abut against both side edges of the sheet stacked onto the intermediate processing tray 409, to thereby align the sheet. Further, as illustrated in FIGS. 5A and 5B, the intermediate processing tray 409 includes the draw-in paddle 414, trailing edge drop members 412, and an upper openable/closable guide 401 arranged at its upper edge portion corresponding to a downstream edge portion in the discharge direction. Still further, the intermediate processing tray 409 includes, on the upstream side in the discharge direction, the belt roller 416 serving as a rotary member, and the trailing edge stopper 417 serving as a regulating portion configured to abut against an upstream edge of the sheet in the discharge direction.

When a trailing edge of the sheet conveyed onto the intermediate processing tray passes through a nip of the lower discharge roller pair 513 serving as the sheet conveying portion, the trailing edge-drop members 412 are moved downwardly and biased toward the intermediate processing tray 409. After that, through counterclockwise rotation of the draw-in paddle 414 and the belt roller 416, the upstream edge of the sheet in the discharge direction (upstream edge in a conveying direction) is brought into abutment against the trailing edge stopper 417, and thus the position of the trailing edge of the sheet in the discharge direction is aligned (regulated).

Figure 6A:
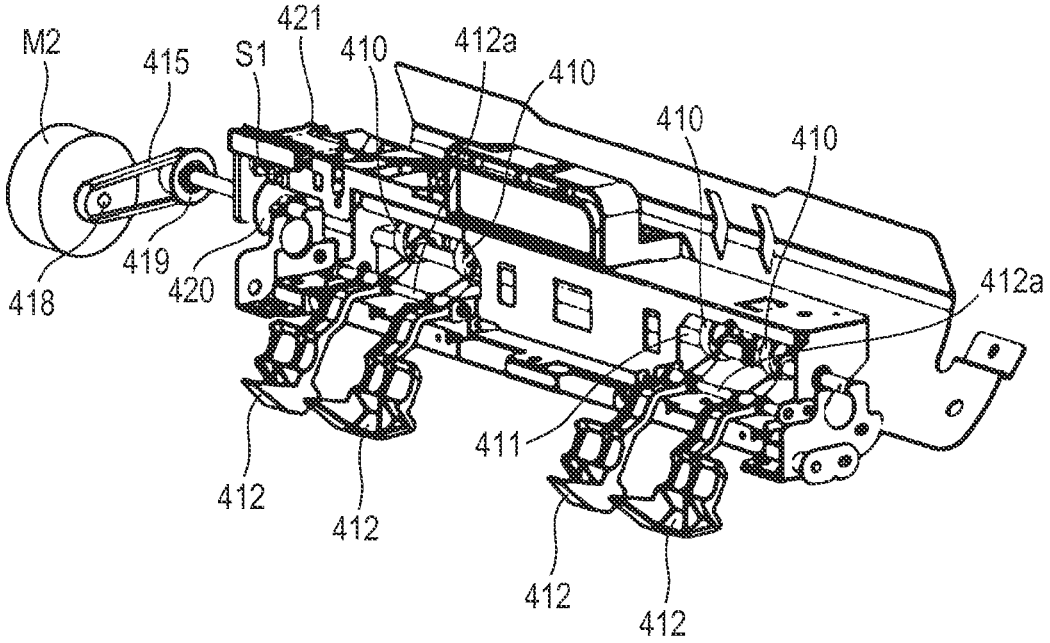
FIGS. 6A and 6B illustrate trailing edge drop members provided to the stapling portion.
Figure 6B:
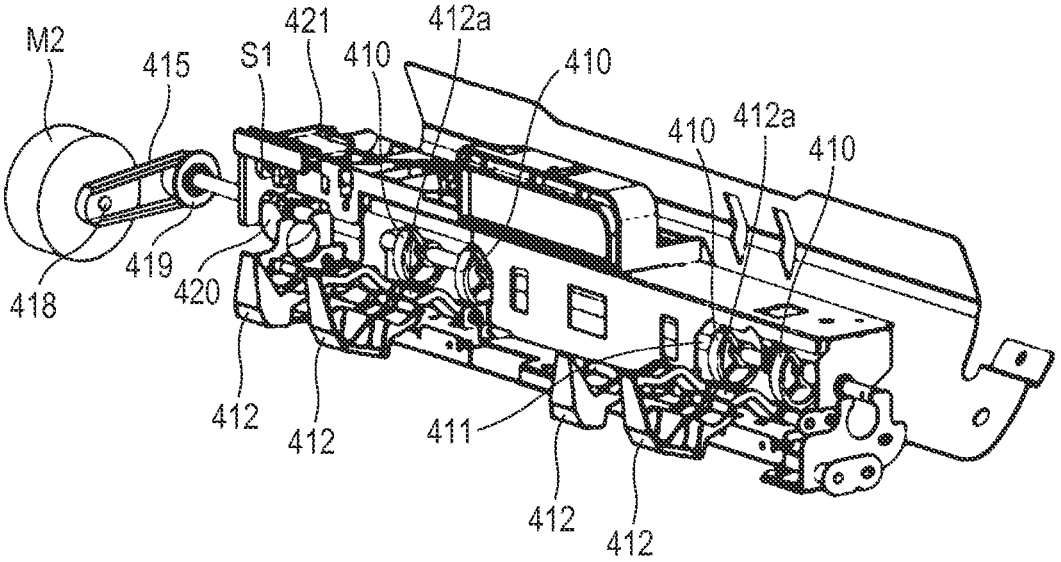

The draw-in paddle 414 is arranged above the intermediate processing tray 409, and is rotatable about a paddle drive shaft 413. As illustrated in FIGS. 6A and 6B, a plurality of the trailing edge drop members 412 are provided to trailing edge drop member rotation shafts 412*a*, which are supported by a trailing edge drop member holder 421 in a rotatable manner. A cam shaft 411 which can be rotated by the trailing edge drop member drive motor M2 is attached to the trailing edge drop member holder 421. A pulley 419 is attached to one end of the cam shaft 411. The drive of the trailing edge drop member drive motor M2 is transmitted to the pulley 419 via a timing belt 415, to thereby rotate the cam shaft 411. A trailing edge drop member HP flag 420 and cams 410 for raising the trailing edge drop members 412 by pressing end portions of the trailing edge drop members 412 on one side are attached to the cam shaft 411.

The trailing edge drop member HP sensor S1 provided to trailing edge drop member holder 421 detects the position of the trailing edge drop member HP flag 420, and thus the finisher control portion 636 controls the positions of the trailing edge drop members 412. The cams 410 are provided corresponding to the respective trailing edge drop members 412, and all the cams 410 have the same phase. Thus, through the rotation of the cams 410 by the trailing edge drop member drive motor M2, the trailing edge drop members 412 can be lowered at the same time.

The home positions (HPs) of the trailing edge drop members 412 correspond to positions illustrated in FIG. 6B, that is, states in which the trailing edge drop members 412 are raised upwardly. When the sheet is to be received, the trailing edge drop members 412 are positioned at the respective HPs. The finisher control portion 636 drives the trailing edge drop member drive motor M2 based on a detection signal from the lower discharge sensor S3 illustrated in FIGS. 5A and 5B, to thereby move the trailing edge drop members 412 to sheet upper surface holding-down positions illustrated in FIG. 6A.

As illustrated in FIG. 5A, a bundle discharge roller pair 514 serving as a rotary member pair including lower bundle discharge rollers 514*a* serving as a first rotary member and upper bundle discharge rollers 514*b* serving as a second rotary member is provided on the downstream side of the intermediate processing tray 409 in the discharge direction. The upper openable/closable guide 401, which is supported so as to be pivotable about a support shaft 401*a* in a vertical direction, holds the upper bundle discharge rollers 514*b* so as to be rotatable and brought into contact with and separated away from the lower bundle discharge rollers 514*a*. A lower surface of the upper openable/closable guide 401 functions as an upper conveying guide opposed to the intermediate processing tray 409.

Due to the configuration that the upper bundle discharge rollers 514*b* are supported by the upper openable/closable guide 401, when the upper openable/closable guide 401 is pivoted upwardly, the upper bundle discharge rollers 514*b* can be separated away from the lower bundle discharge rollers 514*a*. When a first sheet for forming the sheet bundle is to be conveyed onto the intermediate processing tray 409, the upper openable/closable guide 401 is generally pivoted upwardly. Thus, the upper bundle discharge rollers 514*b* are separated away from the lower bundle discharge rollers 514*a*, which are the other rollers of The bundle discharge roller pair 514.

When the upper openable/closable guide 401 is pivoted upwardly, the sheet conveyed from the lower discharge roller pair 513 is slid down along a stacking surface of the intermediate processing tray 409 or a sheet stacked on the intermediate processing tray 409 due to the draw-in paddle 414 and the inclination of the intermediate processing tray 409. After that, the sheet thus slid down is conveyed (transported) through the counterclockwise rotation of the belt roller 416, and is stopped when the trailing edge (upstream edge in the discharge direction) is brought into abutment against the trailing edge stopper 417.

After that, the sheet is aligned in the width direction on the intermediate processing tray 409. This operation is performed every time a sheet is conveyed onto the intermediate processing tray 409 until the sheet bundle is formed. After that, the sheet bundle formed of the plurality of sheets is subjected to a process such as binding. When the process for the sheet bundle is finished on the intermediate processing tray 409, the upper openable/closable guide 401 is pivoted downwardly. Thus, the upper bundle discharge rollers 514*b* are lowered, to thereby nip the sheet bundle between the upper bundle discharge rollers 514*b* and the lower bundle discharge rollers 514*a*. After that, the bundle discharge roller pair 514 is driven, to thereby discharge the sheet bundle onto the lower stacking tray 516 (see FIG. 2).

Figure 9A:
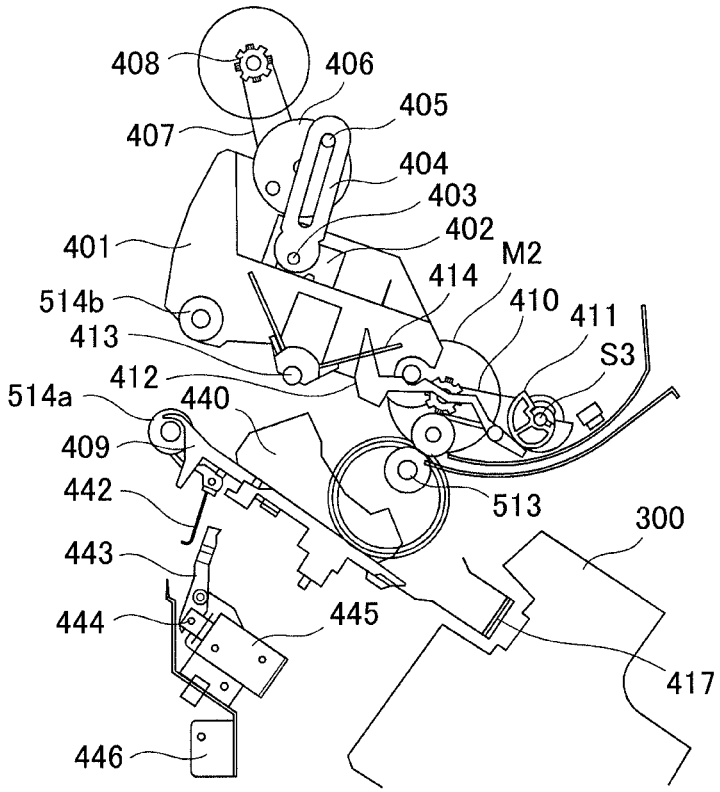
FIGS. 9A and 9B illustrate an operation of each of the stiffness imparting members provided to the stapling portion.
Figure 9B:
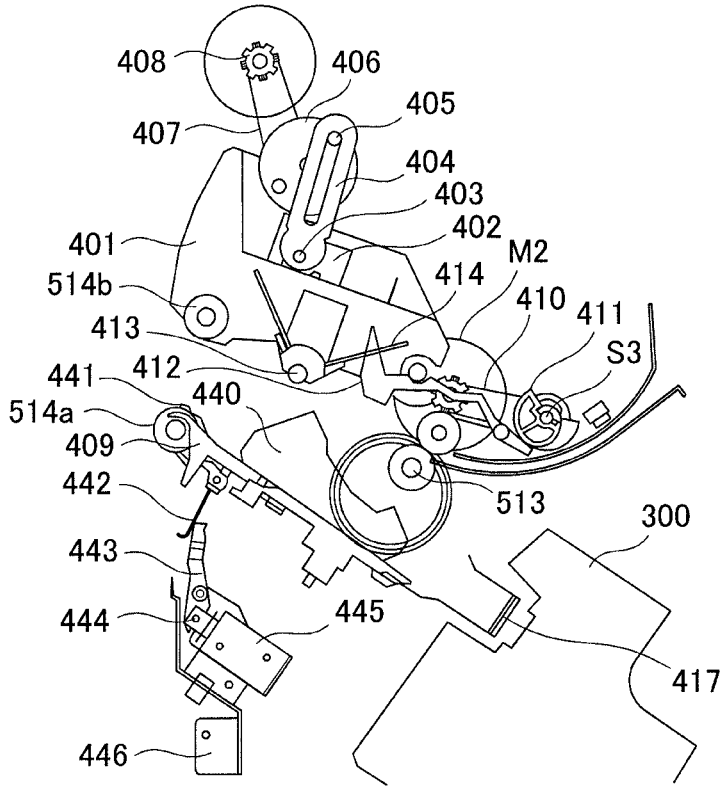

Next, a configuration for opening and closing the upper openable/closable guide 401 and a configuration for driving the bundle discharge roller pair 514 are described with reference to FIGS. 5A and 5B and FIGS. 7A and 7B. As illustrated in FIGS. 5A and 5B and FIGS. 7A and 7B, opening/closing plates 402 for the openable/closable guide are attached to the upper openable/closable guide 401. Opening/closing shafts 403 are crimped to the opening/closing plates 402 for the openable/closable guide, and opening/closing links 404 are attached to the opening/closing shafts 403, respectively. Guide grooves 404*a* are formed in the opening/closing links 404, and rotation shafts 405 provided on link rotating plates 406 are inserted into the guide grooves 404*a*, respectively. When the link rotating plates 406 are rotated, the rotation shafts 405 are moved in the guide grooves 404*a* along with the rotation, and as illustrated in FIGS. 9A and 9B, the opening/closing links 404 are lifted upwardly along with the movement. As a result, the upper openable/closable guide 401 is pivoted upwardly.

Figure 7A:
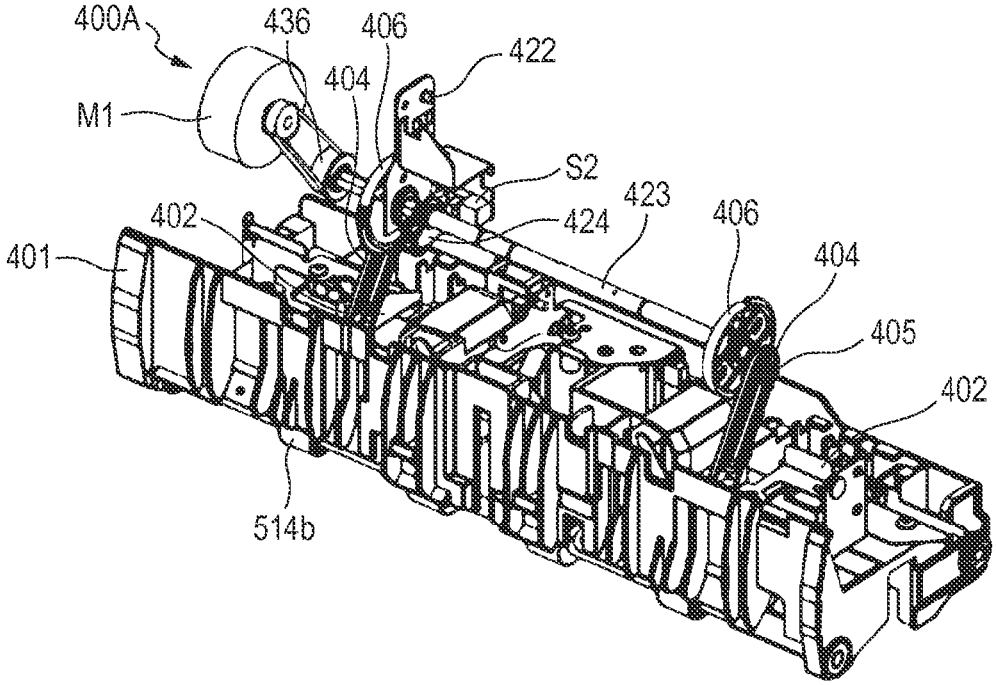
FIGS. 7A and 7B illustrate a configuration for opening and closing an upper openable/closable guide provided to the stapling portion, and a configuration for driving a bundle discharge roller pair.
Figure 7B:
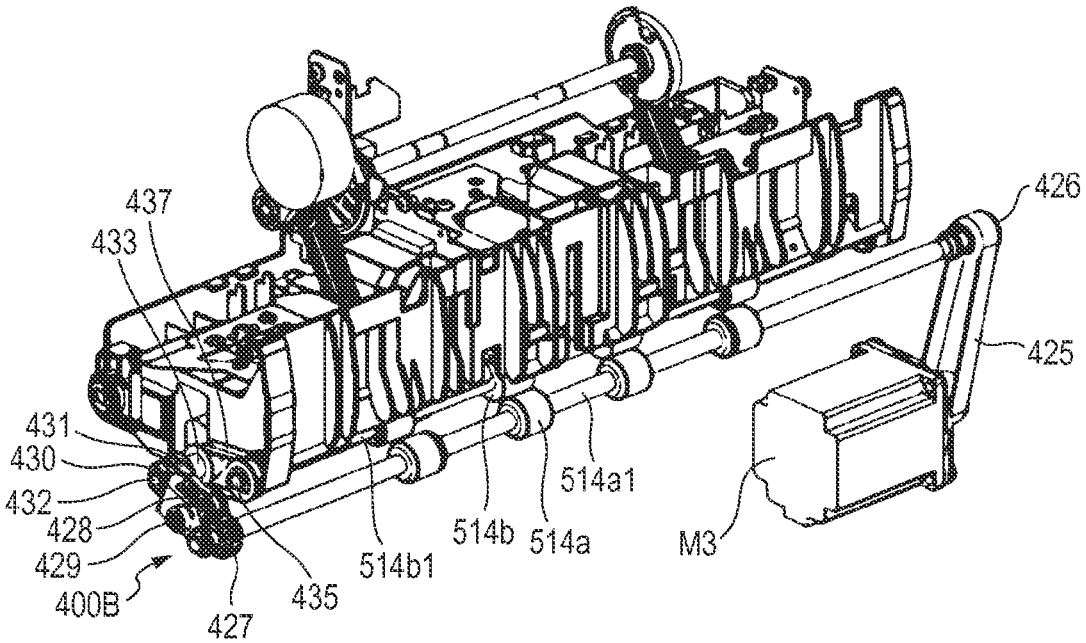

As illustrated in FIGS. 7A and 7B, the opening/closing links 404 and the link rotating plates 406 are provided on a near side and a far side, and an operation of opening and closing the upper openable/closable guide 401 is performed at two positions on the near side and the far side. The two link rotating plates 406 are attached to an opening/closing drive shaft 423, and a pulley 436 is fixed to one end of the opening/closing drive shaft 423. The drive of the opening/closing motor M1 for the upper openable/closable guide is transmitted to the pulley 436 via a motor pulley 408 and a timing belt 407 illustrated in FIGS. 5A and 5B, to thereby rotate the opening/closing drive shaft 423 and therefore rotate the link rotating plates 406.

In this embodiment, the opening/closing links 404, the link rotating plates 406, the upper openable/closable guide 401, the opening/closing motor M1 for the upper openable/closable guide, and the like serve as a moving portion 400A configured to move the upper bundle discharge rollers 514*b*. When a sheet is to be stacked onto the intermediate processing tray 409, the upper bundle discharge rollers 514*b* are moved by the moving portion 400A to a position separated away from the lower bundle discharge rollers 514*a*. When a processed sheet bundle is to be discharged, the upper bundle discharge rollers 514*b* are moved to a position for nipping the sheet bundle between the upper bundle discharge rollers 514*b* and the lower bundle discharge rollers 514*a*.

As illustrated in FIG. 7A, an upper openable/closable guide HP sensor flag 424 is formed on the opening/closing drive shaft 423. The upper openable/closable guide HP sensor S2 provided to a sensor support plate 422 fixed to a processing portion stay (not shown) detects the position of the upper openable/closable guide HP sensor flag 424, and thus the finisher control portion 636 controls the position of the upper openable/closable guide 401.

Next, the drive of the bundle discharge roller pair 514 is described. As illustrated in FIG. 7B, a pulley 426 is attached to one end portion of a roller shaft 514*a*1 of the lower bundle discharge rollers 514*a* of the bundle discharge roller pair 514. The drive of the bundle discharge motor M3 serving as a drive portion fixed to a processing portion side plate not shown) and rotatable in forward and reverse directions is transmitted to the pulley 426 via a timing belt 425, to thereby rotate the lower bundle discharge rollers 514*a*.

A drive gear 427 is provided to the other end portion of the roller shaft 514*a*1 of the lower bundle discharge rollers 514*a*. The drive gear 427 meshes with one gear of an idler gear 428 attached to an idler shaft 429. The idler gear 428 is a stepped gear. A timing belt 430 is looped between the other gear of the idler gear 428, which does not mesh with the drive gear 427, and an idler pulley 431 attached to an idler shaft 432.

An idler pulley 433 is provided coaxially with the idler pulley 431. A timing belt 437 is looped between the idler pulley 433 and a drive pulley 435 attached to one end of a roller shaft 514*b*1 of the upper bundle discharge rollers 514*b*. Thus, the drive of the bundle discharge motor M3 is transmitted to both of the lower bundle discharge rollers 514*a* and the upper bundle discharge rollers 514*b*. In this embodiment, the drive gear 427, the idler gear 428, the timing belt 430, the timing belt 437, The drive pulley 435, and the like serve as a drive transmission portion 400B, which is a drive transmission unit configured to transmit the drive of the lower bundle discharge rollers 514*a* to the upper bundle discharge rollers 514*b*.

In this embodiment, through the forward rotation of the bundle discharge motor M3, the bundle discharge roller pair 514 is rotated in the sheet discharge direction, to thereby discharge the sheet bundle from the intermediate processing tray 409. Through the reverse rotation of the bundle discharge motor M3, the bundle discharge roller pair 514 is rotated in the reverse direction, to thereby convey the sheet, which is conveyed from the lower discharge roller pair 513, to the trailing edge stopper 417.

Figure 8A:
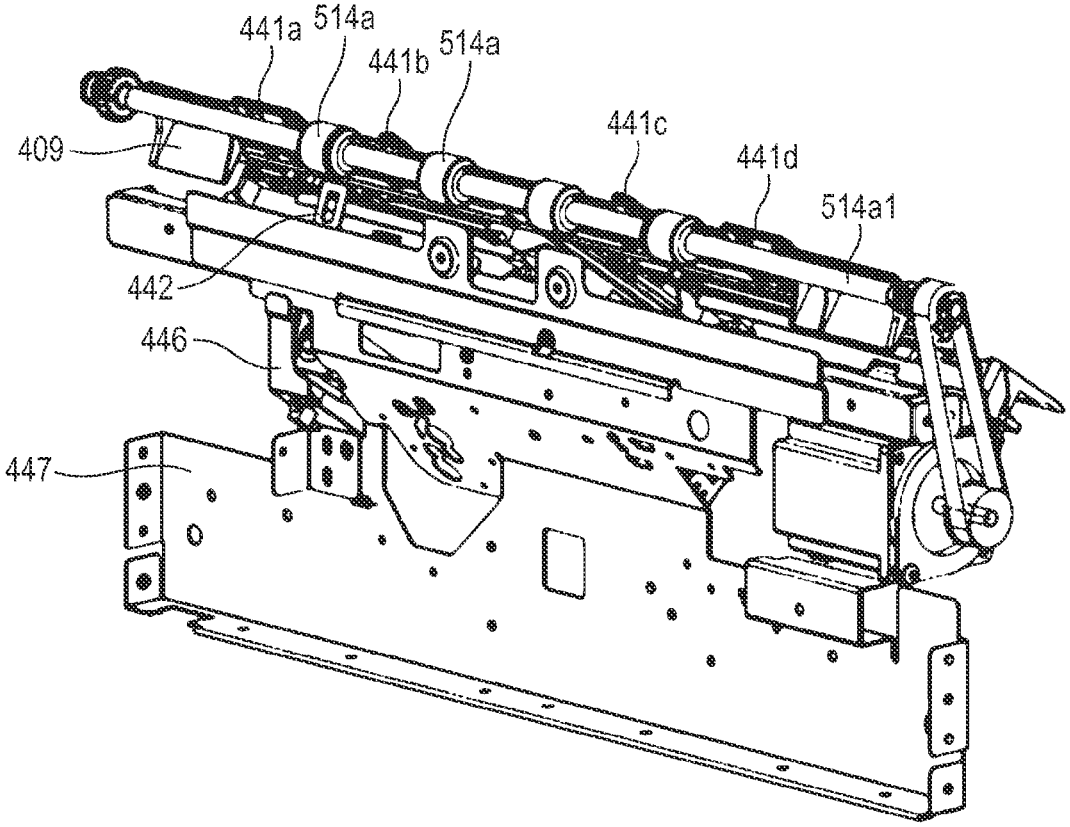
FIGS. 8A and 8B illustrate stiffness imparting members provided to the stapling portion.
Figure 8B:
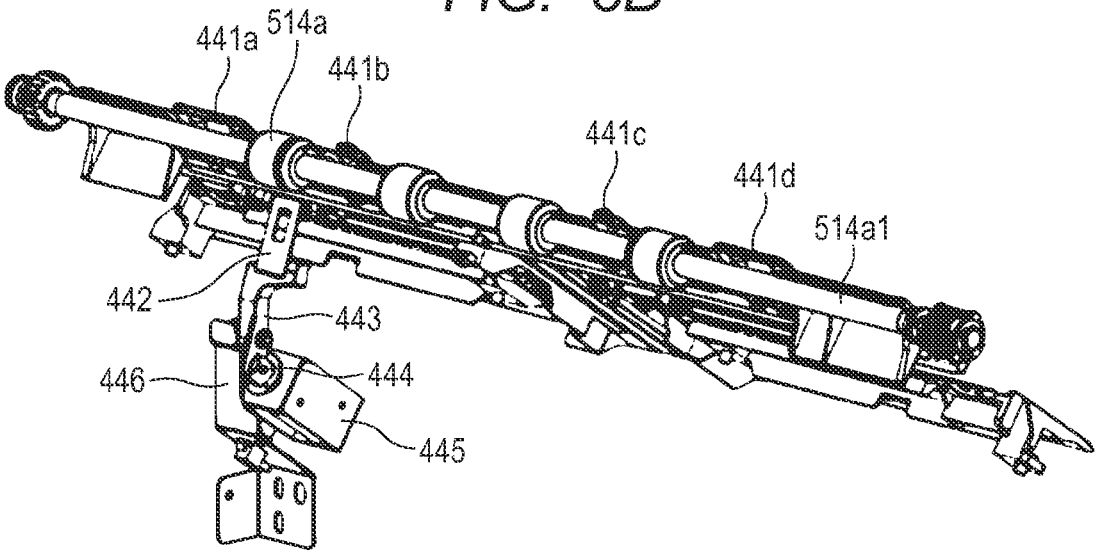

In this embodiment, as illustrated in FIG. 8A, stiffness imparting members 441 (441*a*, 441*b*, 441*c*, and 441*d*) configured to impart stiffness to the sheet stacked on the intermediate processing tray 409 are provided in the vicinity of the lower bundle discharge rollers 514*a*. The stiffness imparting members 441 are attached to a stiffness imparting member attaching plate 442. The stiffness imparting member attaching plate 442 is pivotable by the stiffness imparting member biasing solenoid 445 serving as a drive portion for a separation portion illustrated in FIG. 8B. The stiffness imparting member biasing solenoid 445 is attached to a solenoid support plate 446 provided to a frame 447.

A solenoid link 443 configured to press the stiffness imparting member attaching plate 442 and a link pivot shaft 444 configured to move the solenoid link 443 are attached to the stiffness imparting member biasing solenoid 445. When the stiffness imparting member biasing solenoid 445 is turned ON, the link pivot, shaft 444 is pulled, and the solenoid link 443 is pivoted along with the pull of the link pivot shaft 444, to thereby press the stiffness imparting member attaching plate 442. Thus, the stiffness imparting member attaching plate 442 is moved from a position illustrated in FIG. 9A to a position illustrated in FIG. 9B. Through the movement of the stiffness imparting member attaching plate 442 as described above, the stiffness imparting members 441 protrude upwardly with respect to the lower bundle discharge rollers 514*a* as illustrated in FIG. 9B, to thereby impart stiffness to the sheet bundle.

In this embodiment, the stiffness imparting members 441 protrude after the sheet bundle is bound. After the stiffness imparting members 441 protrude, the upper openable/closable guide 401 is pivoted downwardly so as to bring the upper bundle discharge rollers 514*b* into abutment against the sheet bundle. Then, the sheets are biased toward the upper bundle discharge rollers 514*b*. Thus, the sheet bundle is pressed against the protruding stiffness imparting members 441, with the result that stiffness is imparted to the sheet bundle.

That is, in this embodiment, the stiffness imparting members 441 protrude under a state in which the upper openable/closable guide 401 is pivoted upwardly and the upper bundle discharge rollers 514*b* are therefore separated away from the lower bundle discharge rollers 514*a*. When the stiffness imparting members 441 protrude in this state, the sheet bundle is pushed up by the stiffness imparting members 441, and thus the sheet bundle is separated away from the lower bundle discharge rollers 514*a*. Accordingly, even when the bundle discharge roller pair 514 is driven before discharging the sheet bundle, the lower bundle discharge rollers 514*a* can be prevented from rubbing against a lower sheet of the sheet bundle. As a result, it is possible to prevent degradation of the quality of a product, which may be caused by rubbing marks generated on the lower sheet of the sheet bundle by the lower bundle discharge rollers 514*a*.

Figure 10A:
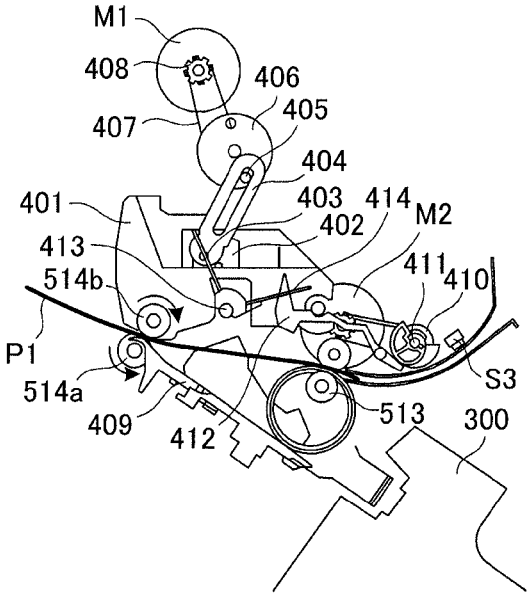
FIGS. 10A, 10B, and 10C are first views illustrating an operation in a binding job of the finisher.
Figure 10B:
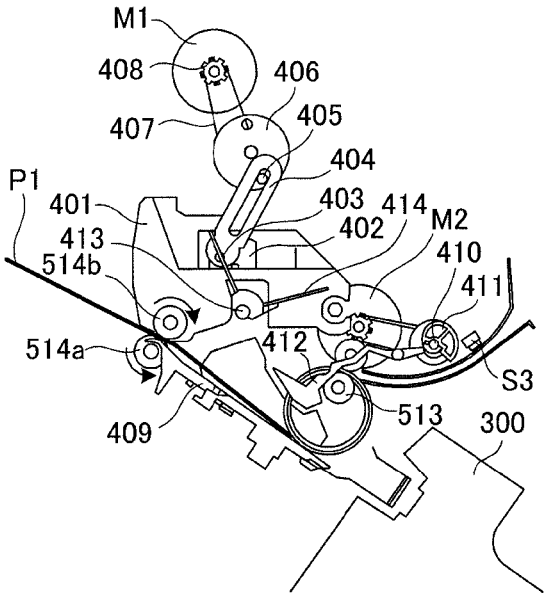

Next, an operation to be performed in a binding job of the stapling portion according to this embodiment is described with reference to FIGS. 10A, 10B, and 10C, FIGS. 11A, 11B, 11C, and 11D, and a flow chart of FIG. 12. When a user selects the binding process with the operation portion 601 to start the binding job, the copying machine main body 100 starts to convey a first sheet (S801). The sheet P1 is conveyed to the lower discharge roller pair 513 and the bundle discharge roller pair 514. At this time, the bundle discharge roller pair 514 is rotated in a direction indicated by the arrows in FIG. 10A (sheet discharge direction), which corresponds to a second direction.

The lower discharge sensor 33 detects the sheet P1 and switches ON ("Y" in Step S802). Based on this detection, the finisher control portion 636 then activates the trailing edge drop member drive motor M2 so as to lower the trailing edge drop members 412 as illustrated in FIG. 10B. Thus, a trailing edge portion of the sheet is dropped by the trailing edge drop members 412 while being biased toward a position at which the sheet can be drawn by the belt roller 416. After the trailing edge drop members 412 are lowered, the bundle discharge motor M3 is stopped (S803) so as to stop the bundle discharge roller pair 514.

Figure 10C:
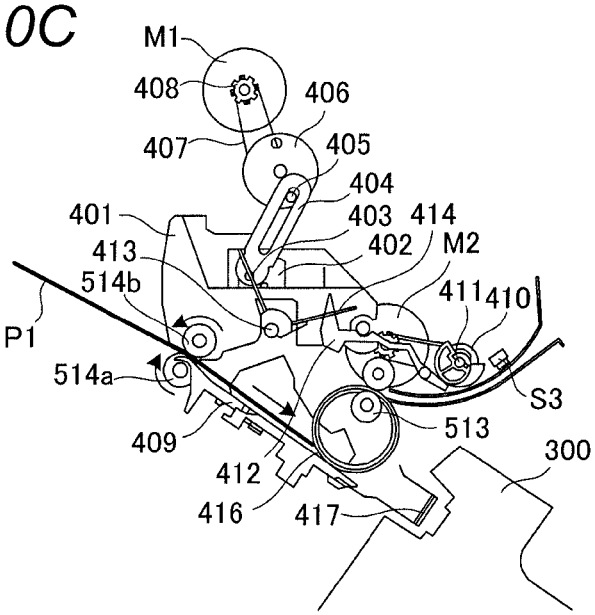
Figure 11A:
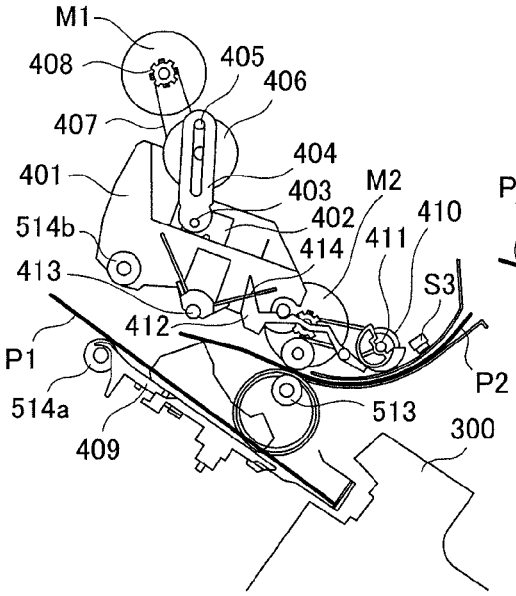
FIGS. 11A, 11B, 11C, and 11D are second views illustrating the operation in the binding job of the finisher.
Figure 11B:
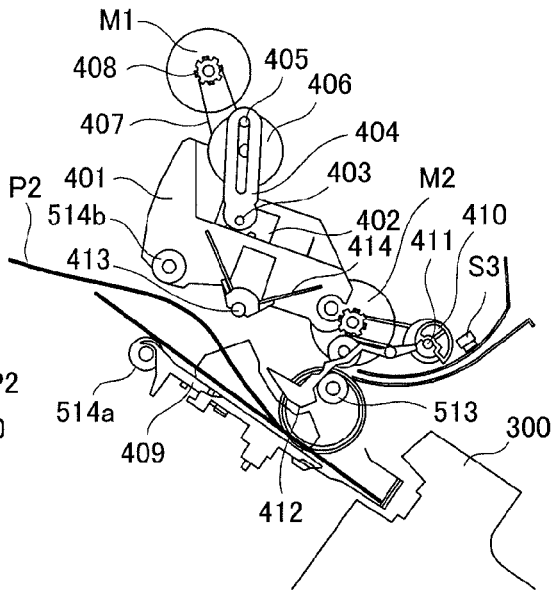

Next, as illustrated in FIG. 10C, the finisher control portion 636 causes the bundle discharge motor M3 to rotate in a reverse direction (S804) so as to rotate the bundle discharge roller pair 514 in a direction indicated by the arrows (direction opposite to the sheet discharge direction), which corresponds to a first direction. Thus, the sheet P1 is conveyed to the belt roller 416. When the sheet P1 is conveyed to the belt roller 416, the opening/closing motor M1 for the upper openable/closable guide is then activated so as to pivot the upper openable/closable guide 401 upwardly before the trailing edge of the sheet P1 abuts against the trailing edge stopper 417 (S805). Thus, the upper bundle discharge rollers 514*b* and the lower bundle discharge rollers 514*a* of the bundle discharge roller pair 514 are separated away from each other. Accordingly, the sheet P1 can be aligned while abutting against the trailing edge stopper 417 in a non-nipped state. When the alignment of the trailing edge of the sheet P1 is finished, the alignment plates 440 are then operated from retreat positions to alignment positions so as to align the sheet P1 in the width direction.

The above description is directed to the operation to be performed in a case where no preceding sheet bundle is being processed on the intermediate processing tray. In a case where a preceding sheet bundle is being processed on the intermediate processing tray, however, a predetermined number of first sheets for forming a succeeding sheet bundle are conveyed in a state of being superimposed one on top of the other. Also in this case, the operation and control are performed in the same manner as in the case were a first single sheet is conveyed onto the intermediate processing tray.

Next, a second sheet P2 is conveyed from the lower discharge roller pair 513 onto the intermediate processing tray 409. At this time, as illustrated in FIG. 11A, the upper openable/closable guide 401 is already positioned at a raised position (a separation position), and thus the upper bundle discharge rollers 514*b* and the lower bundle discharge rollers 514*a* are separated away from each other. When a trailing edge of the sheet P2 passes through the nip of the lower discharge roller pair 513, the finisher control portion 636 causes the trailing edge drop members 412 to be lowered as illustrated in FIG. 11B. Thus, the sheet P2 is dropped onto the intermediate processing tray 409. Next, a returning process, in which the draw-in paddle 414 is rotated counterclockwise, is performed so as to convey the trailing edge of the sheet P2 toward the trailing edge stopper 417. After that, the sheet P2 conveyed onto the intermediate processing tray 409 abuts against the trailing edge stopper 417 so that the sheet P2 is aligned in the conveying direction.

When the alignment of the trailing edge of the sheet P2 is finished, the finisher control portion 636 then operates the alignment plates 440 so as to align the sheet P2 in the width direction similarly to the first sheet P1. After that, a sheet succeeding the second sheet is stacked onto the intermediate processing tray 409 as described above (S806). When the last sheet is conveyed onto the intermediate processing tray ("Y" in Step S807), the last sheet is aligned so that a sheet bundle PA is formed. After that, the sheet bundle PA is bound by the stapler 300 (S808).

Figure 11C:
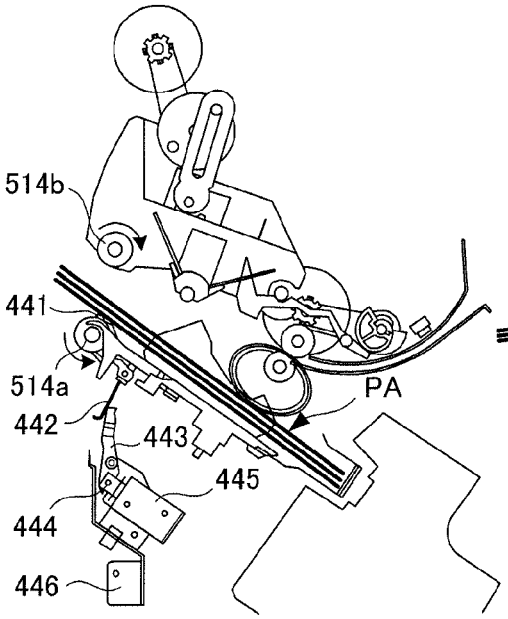
Figure 12:
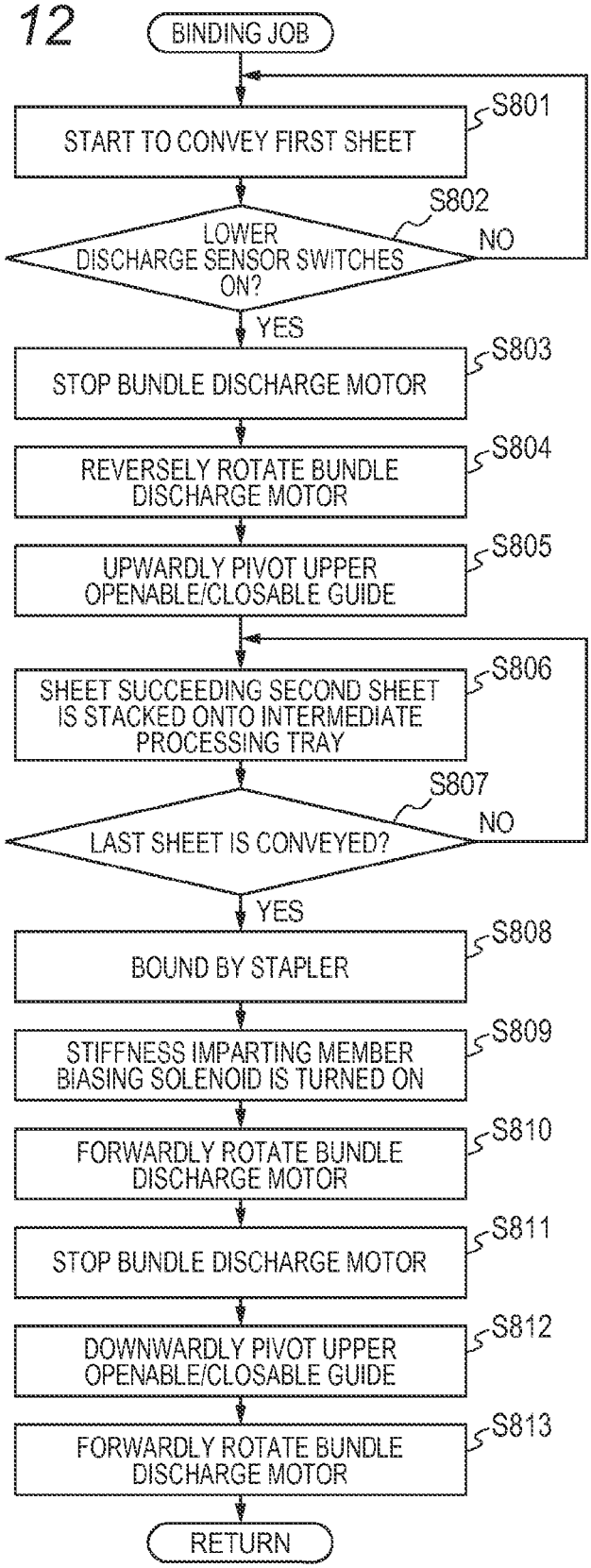
FIG. 12 is a flow chart illustrating control of the binding job of the finisher.

When the binding process is finished, the finisher control portion 636 then turns ON the stiffness imparting member biasing solenoid 445 (S809) so as to protrude the stiffness imparting members 441 with respect to the lower bundle discharge rollers 514*a* as illustrated in FIG. 11C. Thus, a downstream edge portion of the bound sheet bundle PA in the discharge direction is lifted toward the upper bundle discharge rollers 514*b* and separated away from the lower bundle discharge rollers 514*a*. In this state, the bundle discharge motor M3 is rotated in a forward direction at a predetermined clock (S810) so as to rotate the lower bundle discharge rollers 514*a* in a direction indicated by the arrow (discharge direction) by a predetermined amount.

When the first sheet P1 is conveyed to the belt roller 416, the bundle discharge motor M3 is stopped after rotating the lower bundle discharge rollers 514*a* in the direction indicated by the arrow in FIG. 10C, that is, the direction opposite to the sheet discharge direction. Therefore, when the lower bundle discharge rollers 514*a* are rotated in the direction indicated by the arrow in FIG. 11C, backlashes of the meshing gears serving as the drive transmission portion 400B illustrated in FIG. 7B can be eliminated.

Figure 11D:
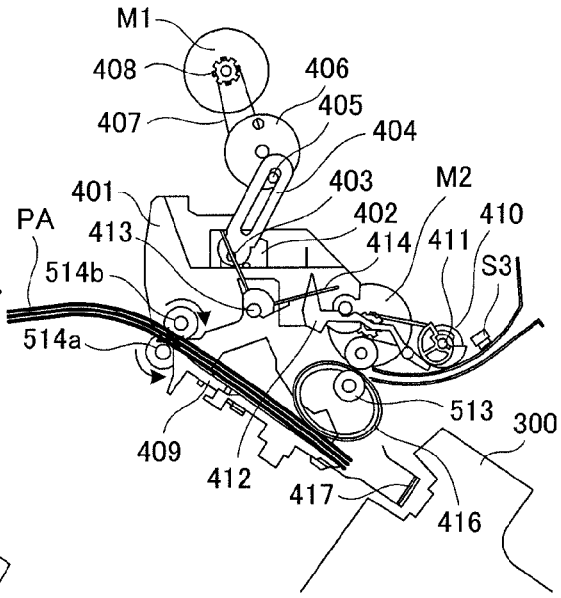

Next, the finisher control portion 636 temporarily stops the bundle discharge motor M3 under a state in which the backlashes are eliminated (S811). After that, the upper openable/closable guide 401 is pivoted downwardly (S812). Thus, as illustrated in FIG. 11D, the upper bundle discharge rollers 514*b* abut against the sheet bundle PA (at a nipping position of the upper bundle discharge rollers 514*b*). At this time, the stiffness imparting members 441 protrude upwardly with respect to the lower bundle discharge rollers 514*a*, and hence stiffness is imparted to the sheet bundle PA. After that, the bundle discharge motor M3 is reactivated so as to rotate in the forward direction (S813) so that the sheet bundle PA is discharged onto stacking tray 516 by the bundle discharge roller pair 514. The backlash elimination only needs to be completed before the sheet bundle PA is nipped by the bundle discharge roller pair 514. The backlashes may be eliminated during a period in which the upper openable/closable guide 401 is pivoted downwardly, and then the bundle discharge motor M3 may be temporarily stopped and the upper bundle discharge rollers 514*b* may be brought into abutment against the sheet bundle PA.

In this embodiment, the stiffness imparting members 441 are protruded with respect to the lower bundle discharge rollers 514*a* before the upper openable/closable guide 401 is pivoted downwardly, and then the backlashes of the drive transmission portion 400B are eliminated. The sheet bundle PA can be lifted by protruding the stiffness imparting members 441 serving as the separation portion, which is provided so as to be protrusible upwardly with respect to the lower bundle discharge rollers 514*a*, to thereby separate the sheet bundle away from the lower bundle discharge rollers 514*a*.

Due to the configuration that the sheet bundle PA is lifted, when the lower bundle discharge rollers 514*a* are rotated by the predetermined amount, the lower bundle discharge rollers 514*a* can be prevented from being brought into contact with the lower sheet of the sheet bundle PA. Thus, when the backlashes of the drive transmission portion 400B are eliminated, rubbing marks due to the lower bundle discharge rollers 514*a* can be prevented from being generated on the lower sheet of the sheet bundle PA.

As described above, in this embodiment, the backlashes of the drive transmission portion 400B are eliminated before the upper openable/closable guide 401 is pivoted downwardly. Due to the configuration that the backlashes of the drive transmission portion 400B are eliminated in this manner, when the sheet bundle is discharged, delay in the drive transmission to the upper bundle discharge rollers 514*b* relative to the drive transmission to the lower bundle discharge rollers 514*a* can be prevented.

That is, in this embodiment, the backlashes of the drive transmission portion 400B are eliminated before the sheet bundle PA is discharged, and the bundle discharge roller pair 514 is rotated in the second direction under a state in which the backlashes of the drive transmission portion 400B are eliminated. Thus, it is possible to prevent generation of creases at the binding portion of the sheet bundle, and to therefore prevent degradation of the quality of a product, which may be caused by the backlashes of the drive transmission portion 400B.

Figure 13:
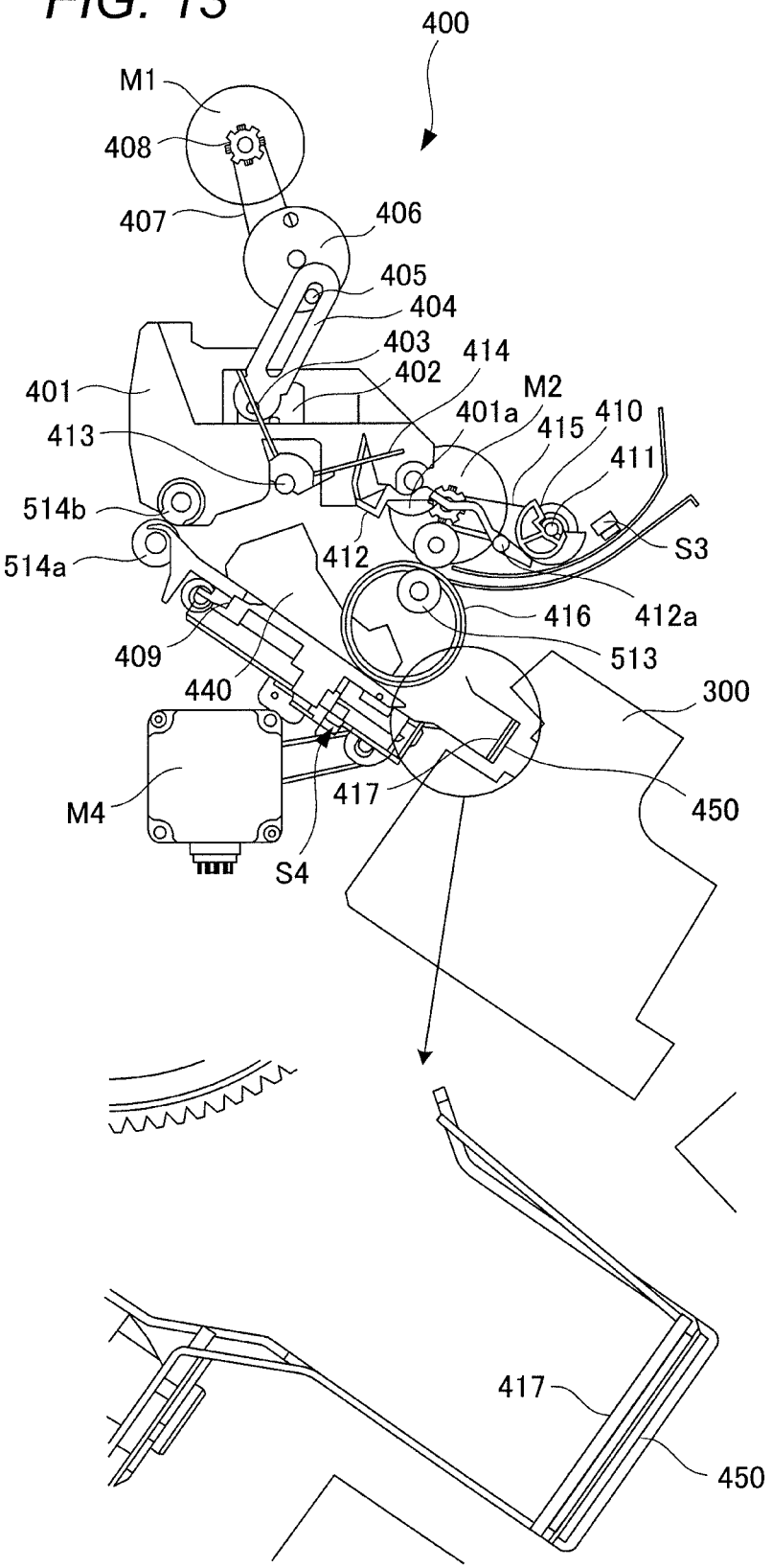
FIG. 13 illustrates a configuration of a stapling portion provided to a sheet processing apparatus according to a second embodiment of the present invention.

Next, a second embodiment of the present invention is described. FIG. 13 illustrates a configuration of a stapling portion provided to a sheet processing apparatus according to the second embodiment of the present invention. In FIG. 13, the same reference symbols as those in FIGS. 5A and 5B represent the same or corresponding parts.

In FIG. 13, a trailing edge push-out member 450 serves as a push-out portion configured to push out, when the sheet bundle bound by the stapler 300 is to be discharged, the sheet bundle by moving in the discharge direction while abutting against the upstream edge of the sheet bundle in the discharge direction. The trailing edge push-out member 450 is positioned on a downstream side of the trailing edge stopper 417 in a sheet abutment direction, which is opposite to the sheet discharge direction. The trailing edge push-out member 450 is configured so that the sheet does not abut against the trailing cage push-out member 450 when the sheet is to be brought into abutment against the trailing edge stopper 417.

In FIG. 13, a trailing edge push-out motor M4 is arranged below the intermediate processing tray 409. A push-out member HP sensor S4 is configured to detect a home position of the trailing edge push-out member 450, at which the sheet does not abut against the trailing edge push-out member 450 when the sheet is to be brought into abutment against the trailing edge stopper 417. The push-out member HP sensor S4 is attached to frame 462. Based on a signal from the push-out member HP sensor S4, the finisher control portion 636 described above drives the trailing edge push-out motor M4 so as to control the position of the trailing edge push-out member 450.

Figure 14A:
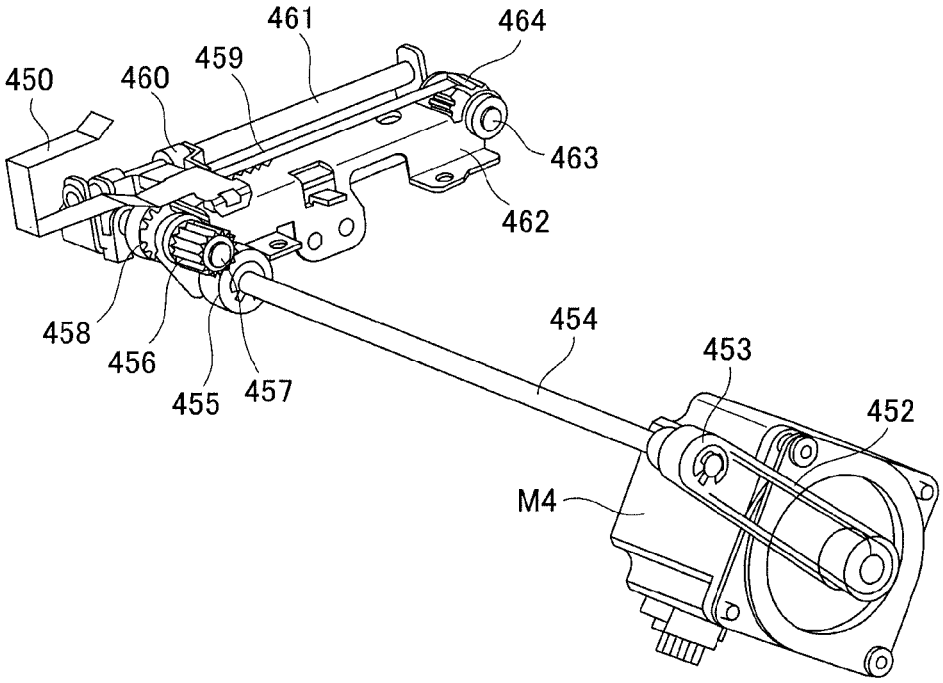
FIGS. 14A and 14B illustrate a trailing edge push-out member provided to the stapling portion.
Figure 14B:
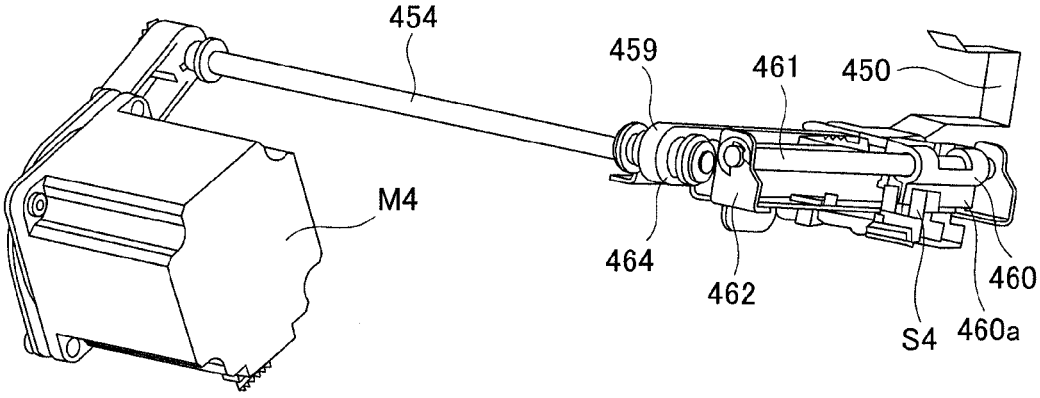

Next, the trailing edge push-out member 450 is described with reference to FIGS. 14A and 14B. In FIG. 14A, a drive belt 459 is configured to move the trailing edge push-out member 450, and a push-out slide 460 is configured to sandwich the drive belt 459 together with the trailing edge push-out member 450. The push-out slide 460 is slidably attached to a slide shaft 461, which is attached to the frame 462.

Drive shafts 463 and 457 are attached to the frame 462. Pulleys 464 and 458 having the drive belt 459 looped therearound are attached to center portions of the drive shafts 463 and 457, respectively. A drive gear 456 is attached to the drive shaft 457. The drive gear 456 meshes with a gear 455 provided at one end of a drive coupling shaft 454 rotatable by the push-out motor M4. Thus, the drive of the push-out motor M4 is transmitted to the drive belt 459 via the gear 455, the drive gear 456, and the pulley 458, and accordingly the drive belt 459 is rotated. Along with the rotation of the drive belt 459, the trailing edge push-out member 450 is moved along the slide shaft 461 together with the push-out slide 460, to thereby push out the sheet bundle.

Figure 15A:
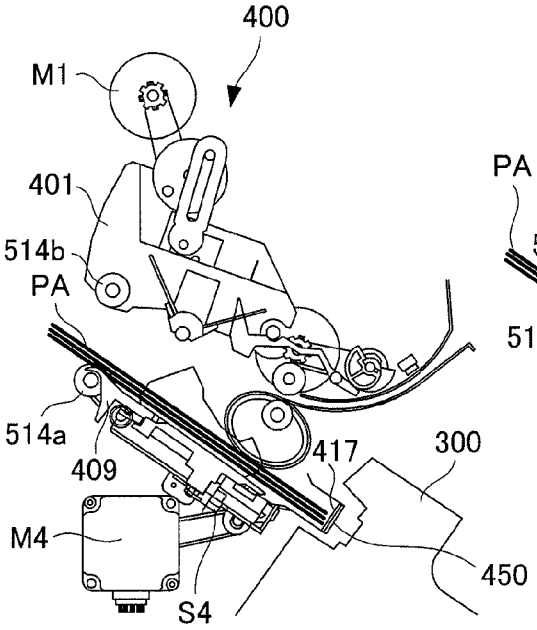
FIGS. 15A, 15B, and 15C illustrate an operation in a binding job of the sheet processing apparatus.

A flag portion 460*a* for switching ON/OFF of the push-out member HP sensor S4 is formed on the push-out slide 460. Based on the ON/OFF of the push-out member HP sensor S4, the finisher control portion 636 controls the position of the trailing edge push-out member 450. FIG. 15A illustrates a state in which the trailing edge push-out member 450 is positioned at the home position. During a period in which the sheet is stacked onto the intermediate processing tray 409, the trailing edge push-out member 450 stands by at the home position.

Figure 15B:
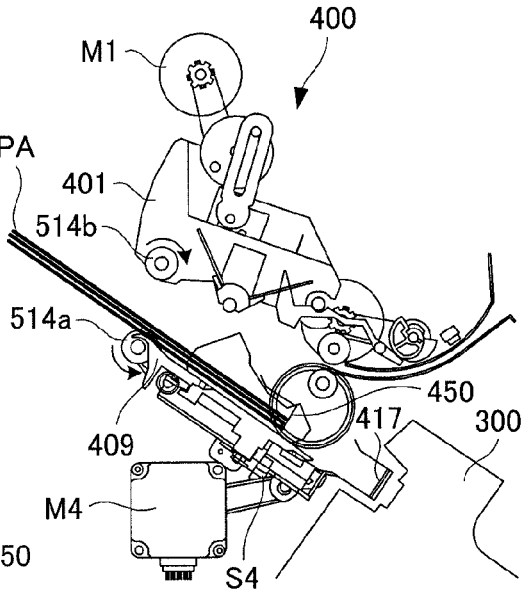
Figure 15C:
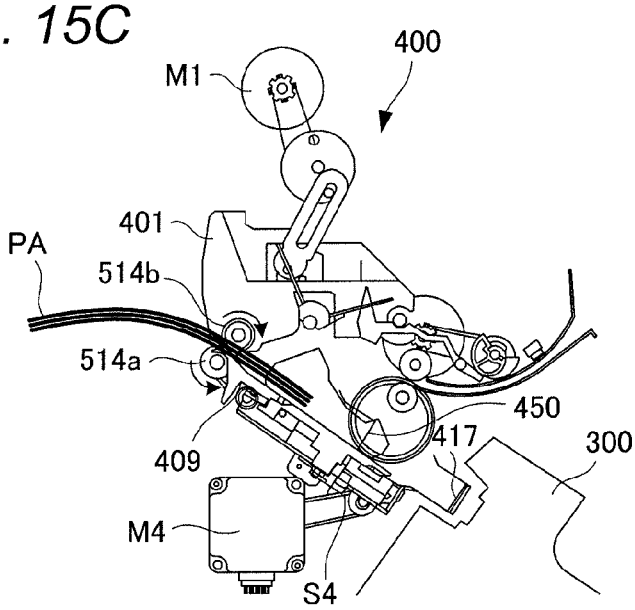
Figure 16:
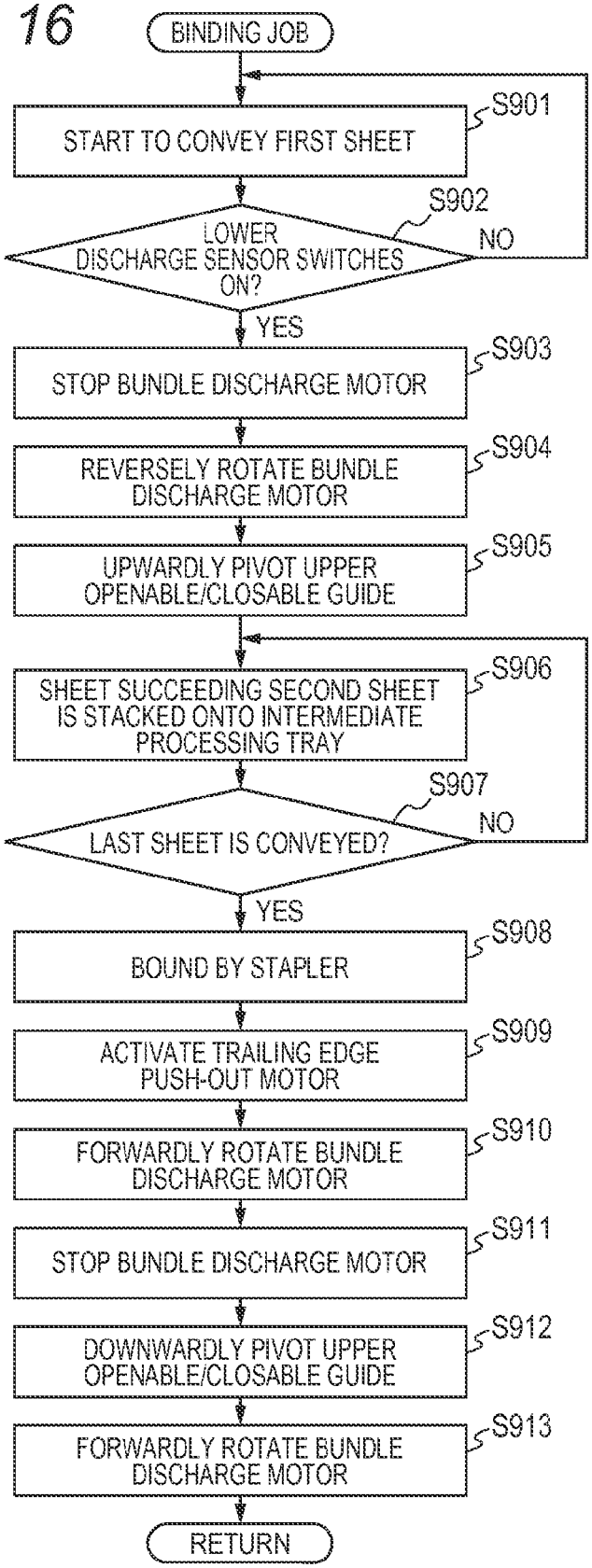
FIG. 16 is a flow chart illustrating control of the binding job of the sheet processing apparatus.

Next, an operation to be performed in a binding job of the stapling portion according to this embodiment is described with reference to FIGS. 15A, 15B, and 15C and a flow chart of FIG. 16. The processes in Steps S901 to S908 of FIG. 16 are processes from the formation of the sheet bundle through the sequential stacking of the sheets onto the intermediate processing tray 409 up to the binding process performed on the sheet bundle PA. Those processes are the same as the processes in Steps S801 to S808 of FIG. 12, and description thereof is therefore omitted herein.

FIG. 15A illustrates a state in which the sheet bundle PA is bound by the stapler 300. In this embodiment, when the sheet bundle PA is bound, the finisher control portion 636 activates the trailing edge push-out motor M4 (S909) so as to move the trailing edge push-out member 450 as illustrated in FIG. 15B, to thereby push the trailing edge of the bound sheet bundle PA. In synchronization with the movement of the trailing edge push-out member 450, the bundle discharge motor M3 is activated so as to rotate in the forward direction (S910) so that the bundle discharge roller pair 514 is rotated in a direction indicated by the arrows (discharge direction). Thus, the backlashes of the drive transmission portion of the bundle discharge roller pair 514 are eliminated.

Next, the bundle discharge motor M3 is temporarily stopped under a state in which the backlashes are eliminated (S911). After that, the upper openable/closable guide 401 is pivoted downwardly (S912). Thus, as illustrated in FIG. 15C, the upper bundle discharge rollers 514*b* abut against the sheet bundle PA. After that, the bundle discharge motor M3 is reactivated so as to rotate in the forward direction (S913) so that the sheet bundle PA is discharged onto the stacking tray 516 by the bundle discharge roller pair 514.

In this embodiment, the trailing edge push-out member 450 is moved before the upper openable/closable guide 401 is pivoted downwardly, and the bundle discharge roller pair 514 is rotated in synchronization with the movement of the trailing edge push-out member 450. Further, in this embodiment, the movement, speed (sheet push-out speed) of the trailing edge push-out member 450 is set equal to the sheet conveyance speed of lower bundle discharge rollers 514*a*. Thus, when the lower bundle discharge rollers 514*a* are rotated, rubbing marks due to the lower bundle discharge rollers 514*a* can be prevented from being generated on the lower sheet of the sheet bundle PA.

As described above, in this embodiment, the trailing edge push-out member 450 is moved before the upper openable/closable guide 401 is closed, and the backlashes of the drive transmission portion 400B of the bundle discharge roller pair 514 are eliminated in synchronization with the movement of the trailing edge push-out member 450. Due to the configuration that the backlashes of the drive transmission portion 400B are eliminated in this manner, when the sheet bundle is discharged, the delay in the drive transmission to the upper bundle discharge rollers 514*b* relative to the drive transmission to the lower bundle discharge rollers 514*a* can be prevented. Thus, it is possible to prevent the generation of creases at the binding portion of the sheet bundle, and to therefore prevent the degradation of the quality of the product, which may be caused by the backlashes of the drive transmission portion 400B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-178991, filed Aug. 30, 2013, which is hereby incorporated by reference herein in its entirety.

What is claimed is:

1. A sheet processing apparatus, comprising:

a sheet conveying portion configured to convey the sheet;

a sheet stacking portion on which a sheet conveyed by the sheet conveying portion is stacked;

a regulating portion configured to regulate a position of the sheet on the sheet stacking portion;

a binding portion configured to bind a plurality of sheets regulated by the regulating portion;

a rotary member pair having a first rotary member and a second rotary member, the rotary member pair configured to convey the sheet toward the regulating portion through rotation in a first direction, and configured to convey a sheet bundle, which is bound by the binding portion, through rotation in a second direction opposite to the first direction;

a moving portion configured to move the second rotary member to a separation position, at which the second rotary member is separated away from the first rotary member, after the rotary member pair conveys the sheet toward the regulating portion, and configured to move the second rotary member from the separation position to a nipping position, at which the second rotary member and the first rotary member nip the sheet bundle, before the rotary member pair conveys the bound sheet bundle;

a drive portion configured to drive the first rotary member and the second rotary member; and a control portion configured to control the drive portion and the moving portion so as to rotate the rotary member pair in the second direction after the second rotary member is moved to the separation position and before the second rotary member is moved to the nipping position.

2. A sheet processing apparatus according to claim 1, further comprising:

a separation portion configured to protrude upwardly with respect to the first rotary member so as to separate the sheet bundle away from the first rotary member; and a drive portion for the separation portion configured to drive the separation portion, wherein, when the second rotary member is in the separation position, the control portion controls the drive portion for the separation portion so as to protrude the separation portion before the rotary member pair is rotated in the second direction.

3. A sheet processing apparatus according to claim 2, wherein, when the second rotary member is moved so that the first rotary member and the second rotary member nip the sheet bundle, the separation portion presses the sheet bundle under a state, in which the separation portion is protruded, and imparts stiffness to the sheet bundle.

4. A sheet processing apparatus according to claim 1, further comprising a push-out portion configured to move in a conveying direction while abutting against an upstream edge of the bound sheet bundle in the conveying direction, wherein, when the sheet bundle is conveyed, the control portion causes the rotary member pair to rotate in the second direction while moving the push-out portion in the conveying direction before the second rotary member is moved to the nipping position.

5. A sheet processing apparatus according to claim 4, wherein a sheet push-out speed of the push-out portion is set equal to a sheet conveyance speed of the rotary member pair.

6. A sheet processing apparatus according to claim 1, wherein the rotary member pair is rotated in the first direction so as to convey a first sheet, which is first stacked onto the sheet stacking portion, toward the regulating portion, and wherein the second rotary member is positioned at the separation position when a succeeding sheet is stacked onto the first sheet.

7. A sheet processing apparatus, comprising:

a sheet stacking portion on which a sheet is stacked;

a binding portion configured to bind a plurality of sheets stacked on the sheet stacking portion;

a rotary member pair configured to convey a sheet toward the binding portion through rotation in a first direction, and configured to convey a bound sheet bundle, which is bound by the binding portion, through rotation in a second direction opposite to the first direction;

a changing portion configured to change a state of the rotary member pair into a state in which the rotary member pair does not nip a sheet after the rotary member pair conveys the sheet toward the binding portion, and thereafter to change the state of the rotary member pair into a nipping state in which the rotary member pair nips the bound sheet bundle;

a drive portion configured to drive the rotary member pair; and a control portion configured to control the drive portion so as to rotate the rotary member pair in the second direction while the state of the rotary member pair is in the state in which the rotary member pair does not nip a sheet.

8. A sheet processing apparatus according to claim 7, further comprising:

a separation portion configured to protrude upwardly with respect to one rotary member of the rotary member pair so as to separate the sheet bundle away from the one rotary member of the rotary member pair; and a drive portion for the separation portion configured to drive the separation portion, wherein, when the rotary member pair is in the separation state, the control portion controls the drive portion for the separation portion so as to protrude the separation portion before the rotary member pair is rotated in the second direction.

9. A sheet processing apparatus according to claim 7, wherein the rotary member pair is rotated in the first direction so as to convey a first sheet, which is first stacked onto the sheet stacking portion, toward the binding portion, and wherein the rotary member pair is in the separation state when a succeeding sheet is stacked onto the first sheet.

10. An image forming apparatus, comprising:

an image forming portion;

a sheet stacking portion on which a sheet having an image formed thereon by the image forming portion is stacked;

a regulating portion configured to regulate a position of the sheet on the sheet stacking portion;

a binding portion configured to bind a plurality of sheets regulated by the regulating portion;

a rotary member pair having a first rotary member and a second rotary member, the rotary member pair configured to convey the sheet toward the regulating portion through rotation in a first direction, and configured to convey a sheet bundle, which is bound by the binding portion, through rotation in a second direction opposite to the first direction;

a moving portion configured to move the second rotary member to a separation position, at which the second rotary member is separated away from the first rotary member, after the rotary member pair conveys the sheet toward the regulating portion, and configured to move the second rotary member from the separation position to a nipping position, at which the second rotary member and the first rotary member nip the sheet bundle, before the rotary member pair conveys the bound sheet bundle;

a drive portion configured to drive the first rotary member and the second rotary member; and a control portion configured to control the drive portion and the moving portion so as to rotate the rotary member pair in the second direction after the second rotary member is moved to the separation position and before the second rotary member is moved to the nipping position.

* * * * *